US010524036B2

(12) United States Patent
Igarashi et al.

(10) Patent No.: US 10,524,036 B2
(45) Date of Patent: Dec. 31, 2019

(54) WEARABLE DEVICE

(71) Applicant: SONY CORPORATION, Tokyo (JP)

(72) Inventors: Go Igarashi, Tokyo (JP); Kohei Asada, Kanagawa (JP); Koji Nageno, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/076,573

(22) PCT Filed: Dec. 27, 2016

(86) PCT No.: PCT/JP2016/088950
§ 371 (c)(1),
(2) Date: Aug. 8, 2018

(87) PCT Pub. No.: WO2017/145521
PCT Pub. Date: Aug. 31, 2017

(65) Prior Publication Data

US 2019/0052949 A1 Feb. 14, 2019

(30) Foreign Application Priority Data

Feb. 23, 2016 (JP) ..... 2016-032277

(51) Int. Cl.
*H04R 17/00* (2006.01)
*H04R 1/10* (2006.01)
(Continued)

(52) U.S. Cl.
CPC ..... *H04R 1/1016* (2013.01); *H04R 1/00* (2013.01); *H04R 1/10* (2013.01); *H04R 1/105* (2013.01);
(Continued)

(58) Field of Classification Search
CPC ... H04R 1/00; H04R 1/10; H04R 1/46; H04R 1/105; H04R 1/1016; H04R 1/1075; H04R 17/00
See application file for complete search history.

(56) References Cited

U.S. PATENT DOCUMENTS 4,736,435 A * 4/1988 Yokoyama ..... H04R 9/10 381/322
2011/0019849 A1 1/2011 Nielsen
(Continued)

FOREIGN PATENT DOCUMENTS

AU 2015282183 A1 2/2016
CN 101953175 A 1/2011
(Continued)

OTHER PUBLICATIONS

International Preliminary Report on Patentability of PCT Application No. PCT/JP2016/088950, dated Sep. 7, 2018, 06 pages of English Translation and 06 pages of IPRP.
(Continued)

*Primary Examiner* — Brian Ensey
(74) *Attorney, Agent, or Firm* — Chip Law Group

(57) ABSTRACT

Provided is a wearable device that is worn on a human ear and mainly outputs or inputs sound. The outer casing 110 is formed into an elongated shape so as to fit the cymba conchae 306 formed between the antihelix inferior crus **302*b* and the crus helicis 309. The sound generating unit 120 includes a vibration element 121 and a weight 122. The vibration element 121 has an elongated shape along the longitudinal direction of the outer casing 110, and has one end fixed to the inner wall of the outer casing 110, and the other end to which a weight 122** is attached, the other hand
(Continued)

being an open end. By applying an alternating electric field to the vibration element 121, vibration corresponding to audio is generated.

18 Claims, 24 Drawing Sheets

(51) Int. Cl.
*H04R 1/00* (2006.01)
*H04R 1/46* (2006.01)

(52) U.S. Cl.
CPC ..... *H04R 1/1075* (2013.01); *H04R 1/46* (2013.01); *H04R 17/00* (2013.01)

(56) References Cited

U.S. PATENT DOCUMENTS

2011/0182454 A1* 7/2011 Larsen ..... H04R 25/652 381/328
2013/0136279 A1* 5/2013 Brown ..... H04R 1/10 381/151

FOREIGN PATENT DOCUMENTS

| | | | |
|---|---|---|---|
| CN | 102742296 | A | 10/2012 |
| CN | 105612760 | A | 5/2016 |
| EP | 2238772 | A1 | 10/2010 |
| EP | 2332343 | A1 | 6/2011 |
| EP | 3016403 | A1 | 5/2016 |
| JP | 55-074197 | U | 5/1980 |
| JP | 55-74197 | U | 5/1980 |
| JP | 2001-333484 | A | 11/2001 |
| JP | 2009-118444 | A | 5/2009 |
| JP | 2011-508548 | A | 3/2011 |
| JP | 4709017 | B1 | 6/2011 |
| JP | 4709017 | B2 | 6/2011 |
| JP | 2011-160175 | A | 8/2011 |
| JP | 2011-524703 | A | 9/2011 |
| KR | 10-2011-0065518 | A | 6/2011 |
| WO | 2009/083008 | A1 | 7/2009 |
| WO | 2009/141912 | A1 | 11/2009 |
| WO | 2010/040350 | A1 | 4/2010 |
| WO | 2015/198683 | A1 | 12/2015 |

OTHER PUBLICATIONS

International Search Report and Written Opinion of PCT Application No. PCT/JP2016/088950, dated Mar. 21, 2017, 07 pages of English Translation and 07 pages of ISRWO.

* cited by examiner

WEARABLE DEVICE

CROSS REFERENCE TO RELATED APPLICATIONS

This application is a U.S. National Phase of International Patent Application No. PCT/JP2016/088950 filed on Dec. 27, 2016, which claims priority benefit of Japanese Patent Application No. JP 2016- 032277 filed in the Japan Patent Office on Feb. 23, 2016. Each of the above-referenced applications is hereby incorporated herein by reference in its entirety.

TECHNICAL FIELD

The technology disclosed in this specification relates to a wearable device used by being attached to a human body, and in particular, the technology relates to a wearable device that is worn on a person's ear and mainly performs output or input of sound.

BACKGROUND ART

A compact sound transducer, that is, an earphone, which converts an electric signal output from a reproducing device or a receiver into a sound signal by a speaker close to an ear or an eardrum, has been widespread. Since this type of sound reproducing device emits sound so that the sound can be heard only by a listener wearing the sound reproducing device, this type of sound reproducing device is being used in various environments.

Many of the earphones which are now in widespread use are shaped to be inserted into the ears of the listener. For example, an inner ear type earphone is a shape that is hung by an auricle of the listener. Furthermore, a canal type earphone has a shape used by being inserted deeply into the hole of the ear (ear canal), and since the canal type earphone is often structurally sealed type and the sound insulation performance is relatively good, there is merit such that music can be enjoyed even in a place where the noise is slightly large.

In general, the canal type earphone generally includes a speaker unit that converts an electric signal into a sound signal, and a speaker unit is attached to one end of the housing (outside of the ear canal) with a substantially cylindrical housing (housing) also serving as a sound tube as a basic component. The housing has a radiation outlet that radiates air vibrations generated by the speaker unit to the ear canal and transmits the air vibrations to the eardrum. In addition, an earpiece (detachable component) having a shape conforming to the ear canal is usually attached to the other end (insertion portion of the ear canal) of the housing when the listener wears the canal type earphone. For example, proposals have been made for a canal type earphone device that can accommodate a sound tube up to an ear canal entrance while storing the housing in a cavum conchae by disposing the sound tube obliquely from a position deviated from the center of the housing (see, for example, Patent Document 1).

Even while the listener wears the earphone and listens to a presented audio, it is necessary to listen to ambient sound at the same time, for example when people around the world speak. It is a dangerous situation that ambient sound cannot be heard, for example, when sports are conducted outdoors and indoors, including walking, jogging, cycling, mountain climbing, skiing, snowboarding, and during driving or navigation. Furthermore, the inability to listen to the ambient sound during communication or presentation causes a decline in service. However, most of the conventional earphones such as a canal type earphone are structured to close an ear hole almost completely in a wearing state, so that it is extremely difficult for the listener to hear ambient sound while listening.

Furthermore, the surrounding people view the listener as if the ear holes of the listener wearing the conventional earphone is blocked, which therefore gives the impression that it is difficult to talk to the wearer of the earphone, and also interferes with communication between people.

CITATION LIST

Patent Document

Patent Document 1: Japanese Patent No. 4709017

SUMMARY OF THE INVENTION

Problems to be Solved by the Invention

The purpose of the technology disclosed in this specification is to provide an excellent wearable device capable of realizing input and output of good sound information at the same time while maintaining the listening characteristic of the ambient sound equivalent to the non-worn state even in a state where the wearable device is worn on a person's ear.

Solutions to Problems

The technology disclosed in this specification has been made in consideration of the above-described problem, and a first aspect is a wearable device including an outer casing having a shape adapted to a first valley portion of an auricle, and a component supported inside the outer casing, the wearable device being disposed in the first valley portion and used while being held by the auricle.

According to the second aspect of the technology disclosed in this specification, the outer casing of the wearable device according to the first aspect is formed in an elongated or streamlined shape adapted to a cymba conchae as the first valley portion. Then, the wearable device is configured to be held by the auricle so as to be sandwiched between an antihelix inferior crus and a crus helicis when placed in the cymba conchae.

According to a third aspect of the technology disclosed in the present specification, the component supported inside the outer casing of the wearable device according to the first aspect includes a sound generating unit that generates audio.

According to a fourth aspect of the technology disclosed in the present specification, the sound generating unit of the wearable device according to the third aspect includes a vibration element and a weight attached to the vibrator.

According to a fifth aspect of the technology disclosed in the present specification, the vibration element of the wearable device according to the fourth aspect has one end that is a fixed end fixed to an inner wall of the outer casing and the other end that is an open end. Then, the weight is attached to a side of the open end.

According to a sixth aspect of the technology disclosed in the present specification, the vibration element of the wearable device according to the fourth aspect includes a bimorph element.

According to a seventh aspect of the technology disclosed in the present specification, the outer casing of the wearable device according to the fourth aspect has an elongated shape. Then, the vibration element is disposed along a longitudinal direction of the outer casing.

According to an eighth aspect of the technology disclosed in the present specification, the outer casing of the wearable device according to the fourth aspect is a completely sealed structure.

According to a ninth aspect of the technology disclosed in the present specification, the outer casing of the wearable device according to a fifth aspect is configured to fix the fixed end of the vibration element at a predetermined crimping pressure.

According to a tenth aspect of the technology disclosed in the present specification, the sound generating unit of the wearable device according to the third aspect includes one of a dynamic speaker, a balanced armor type speaker, a capacitor type speaker, a piezoelectric speaker, and an electrostatic speaker.

According to an eleventh aspect of the technology disclosed in the present specification, the sound generating unit of the wearable device according to the tenth aspect further includes a sound guiding tube.

According to a twelfth aspect of the technology disclosed in the present specification, the sound guiding tube of the wearable device according to the eleventh aspect has a gently curved shape. Furthermore, the sound guiding tube has one end joined to the outer casing. Then, when the outer casing is disposed in the first valley portion, the other end between the sound guides is configured to reach near an ear canal entrance.

According to a thirteenth aspect of the technology disclosed in the present specification, the component supported inside the outer casing of the wearable device according to the third aspect includes a microphone that collects audio.

According to a fourteenth aspect of the technology disclosed in the present specification, the component supported inside the outer casing of the wearable device according to the first aspect includes a sensor.

According to a fifteenth aspect of the technology disclosed in the present specification, the wearable device according to the first aspect further includes a flexible cushion portion that covers the surface of the outer casing.

According to a sixteenth aspect of the technology disclosed in the present specification, the wearable device according to the first aspect further includes an adapter having a holding portion that holds the outer casing and an engaging portion having a shape adapted to a second valley portion of the auricle.

According to a seventeenth aspect of the technology disclosed in the present specification, in the wearable device according to the sixteenth aspect, the first valley portion is a cymba conchae and the second valley portion is a triangular fossa.

According to an eighteenth aspect of the technology disclosed in this specification, the wearable device according to the sixteenth aspect is configured.

According to a nineteenth aspect of the technology disclosed in this specification, the wearable device according to the first aspect further includes a cable that inputs/outputs a signal to/from the component or supplies power to the component.

According to a twentieth aspect of the technology disclosed in the present specification, the wearable device according to the nineteenth aspect connects the cable so as to be along a lower side surface when the outer casing is inserted into the first valley portion.

Effects of the Invention

The technology disclosed in this specification can provide an excellent wearable device capable of realizing input and output of good sound information at the same time while maintaining the listening characteristic of the ambient sound equivalent to the non-worn state even in a state where the wearable device is worn on a person's ear.

Note that the effects described in the present specification are merely examples, and the effects of the present invention are not limited thereto. Further, in addition to the above effects, the present invention may further exert additional effects.

Still other objects, features and advantages of the technology disclosed in this specification will become apparent from a detailed description based on embodiments to be described later and accompanying drawings.

MODE FOR CARRYING OUT THE INVENTION

Hereinafter, embodiments of the technology disclosed in this specification will be described in detail with reference to the drawings.

[First Embodiment ]

Figure 1:
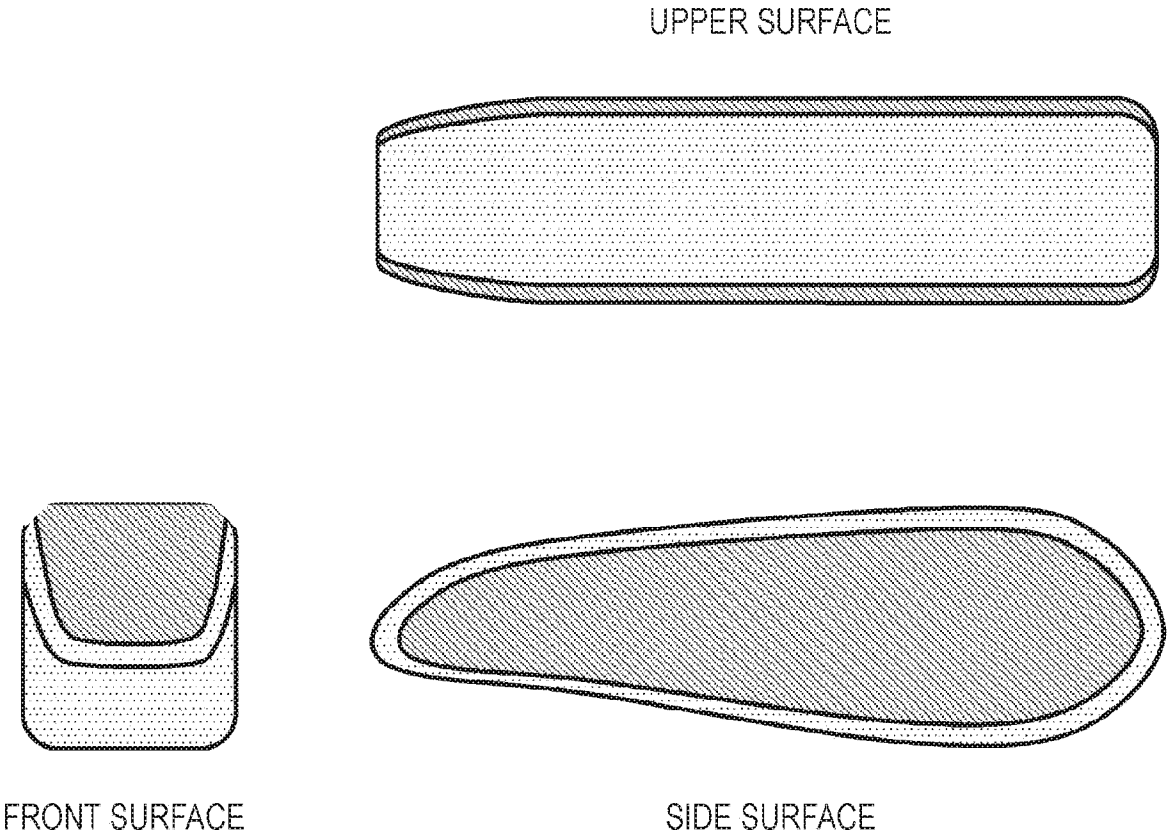
FIG. 1 is a view illustrating an external configuration of a wearable device 100 according to a first example of a technology disclosed in this specification.
Figure 2:
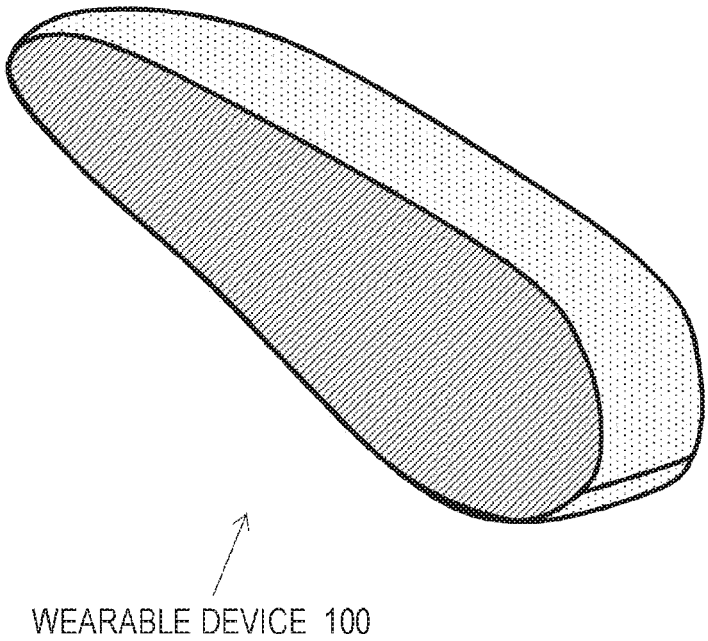
FIG. 2 is a view illustrating an external configuration of the wearable device 100 according to a first example of the technology disclosed in this specification.

FIGS. 1 and 2 are views each illustrating an external configuration of a wearable device 100 according to a first embodiment of the technology disclosed in this specification. However, FIG. 1 is a three-view diagram in which the wearable device 100 is viewed from a front surface, an upper surface, and a side surface, and FIG. 2 is a perspective view of the wearable device 100.

As illustrated in FIGS. 1 and 2, the body of the wearable device 100 has a streamlined shape or an elongated shape. The main use of the wearable device 100 is a sound output of an earphone or the like, and is used by being attached to various portions (depressed portion) of a human auricle.

Since the wearable device 100 is attached to the auricle rather than being inserted into the ear hole like the inner ear type or the canal type earphone, the ear canal is kept released even in the attached state, and the listening characteristic of the ambient sound equivalent to the non-worn state can be maintained.

The wearable device 100 can be used by being inserted into any valley portion of the auricle, such as, for example, a cymba conchae, a cavum conchae, a tagus vicinity, a triangular fossa, a scaphoid fossa or the like.

Figure 3:
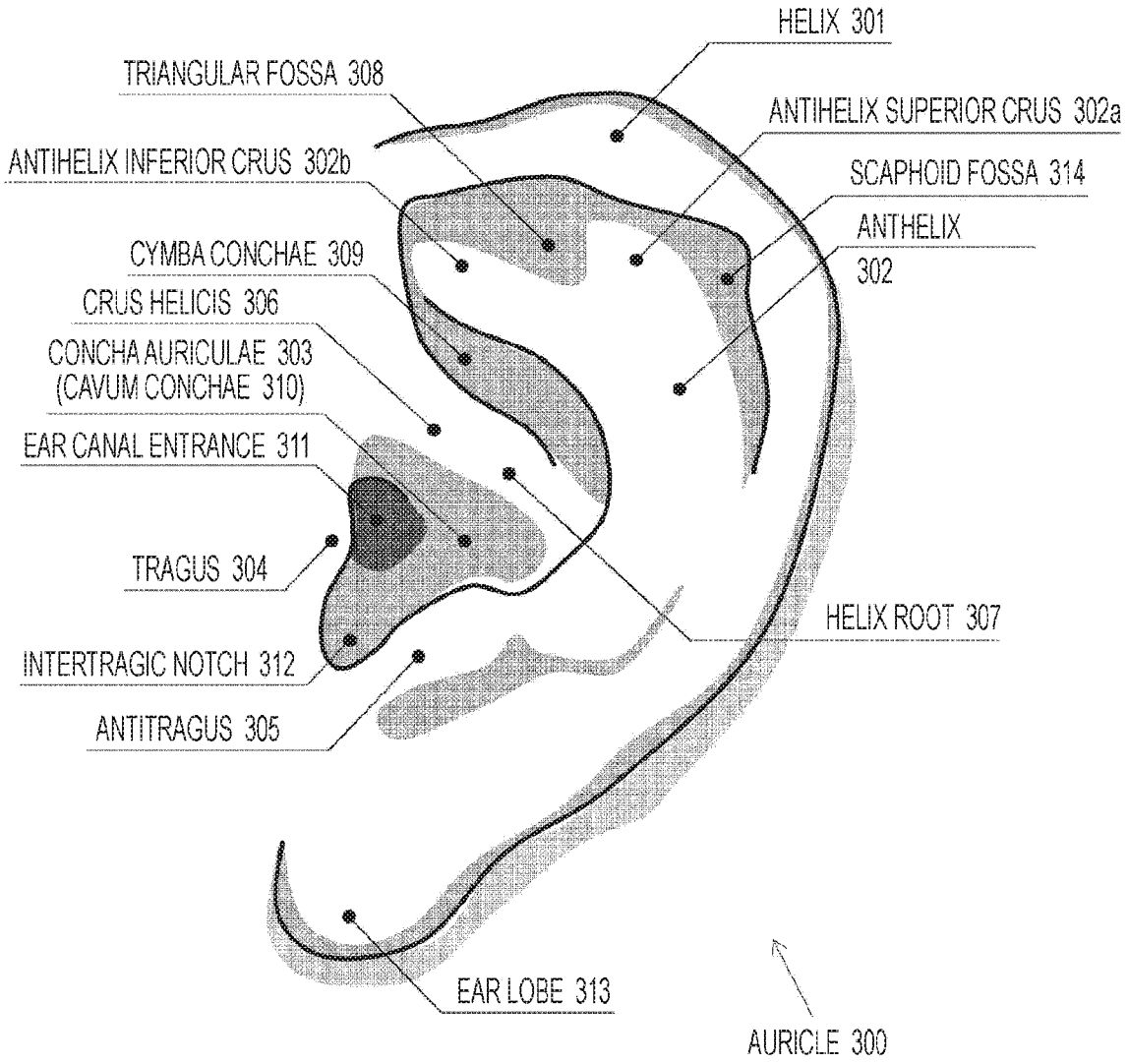
FIG. 3 is a view illustrating a shape of an auricle and the name of each part.

For reference, the shape of the auricle and the name of each part are illustrated in FIG. 3. Broadly speaking, the structure of an auricle 300 includes a helix 301, an anthelix 302, a concha auriculae 303, and a tragus 304 in order from the outside. Furthermore, on the outer side of the tragus 304, there is an antitragus 305 which is a pair of projections. The notch between the tragus 304 and the antitragus 305 is an intertragic notch 312. Furthermore, the lower end of the auricle 300 is an ear lobe 313.

The helix 301 is a portion that forms the outline of the ear at the outermost periphery of the ear. After having curved inwardly near the center of the auricle 300 (near the upper part of an ear canal entrance 311), the helix 301 passes almost horizontally in the vicinity of the center of the auricle 300 and forms a projection that divides the concha auriculae 303 vertically. A crus helicis 306 is a portion where the helix 301 curves toward the inside of the auricle 300 and a helix root 307 is a portion that further enters the concha auriculae 303 of the crus helicis 306.

The anthelix 302 is a ridge line extending upward from the antitragus 305 and also corresponds to a rim of the concha auriculae 303. The ridge line forming the anthelix 302 is bifurcated, and the upper branch is referred to as an antihelix superior crus 302*a*, which corresponds to the upper side of a triangular fossa 308. Furthermore, the lower branch is referred to as an antihelix inferior crus 302*b*, which corresponds to the lower side of the triangular fossa 308.

The concha auriculae 303 is the most depressed part in the middle of the ear, and is divided into the cymba conchae 309 which includes an elongated depression in the upper half and a cavum conchae 310 in the lower half with the helix root 307 as the border. In addition, the ear canal entrance 311 is located near the tragus 304 of the cavum conchae 310.

The triangular fossa 308 is a triangular depression with three sides of the antihelix superior crus 302*a*, the antihelix inferior crus 302*b*, and the helix 301. In addition, a scaphoid fossa 314 is a depression in an upper outer part in terms of the entire auricle 300, the depression being located between the anthelix 302 and the helix 301.

Note that the human auricle mainly includes cartilage and skin. A cartilage present in the portion of the auricle is called an auricular cartilage. However, there is no cartilage in the part of the ear lobe. The auricular cartilage near the cymba conchae is connected to a skull at an anterior auricular muscle, which is easy to transmit the vibration to the eardrum.

Figure 4:
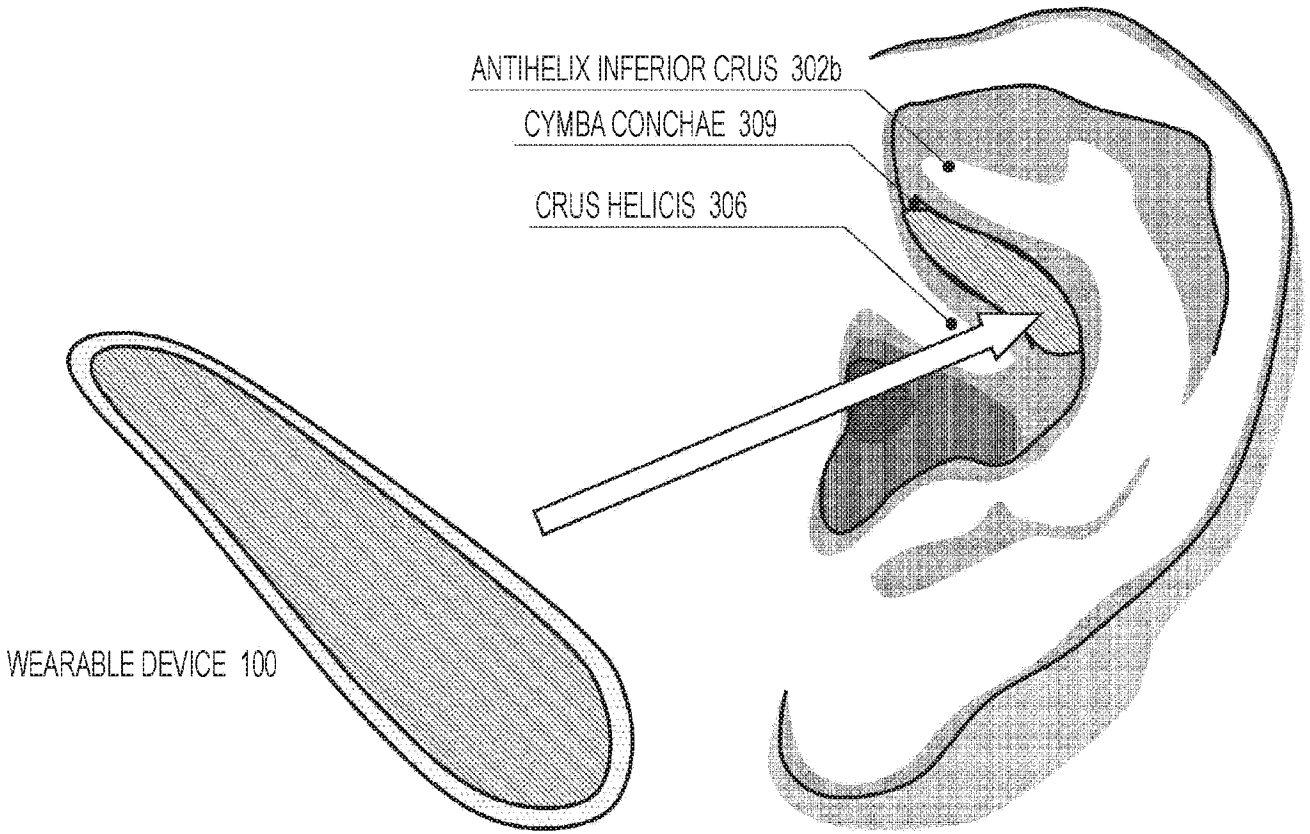
FIG. 4 is a view illustrating a state where the wearable device 100 is inserted in a cymba conchae.

The wearable device 100 according to the first embodiment illustrated in FIG. 1 and FIG. 2 can be used by being inserted into the cymba conchae 309, for example. The cymba conchae 309 is an elongated valley portion (space) formed between the two parts of the antihelix inferior crus 302*b* and the crus helicis 306 (see FIG. 3). FIG. 4 illustrates a state where the wearable device 100 is inserted into the cymba conchae 309. The main body of the wearable device 100 is formed into an elongated (or streamlined) shape so as to fit the cymba conchae 309 and is held by the auricle so as to be sandwiched between the antihelix inferior crus 302*b* and the crus helicis 306. As a modification, the wearable device 100 can be configured so as to be inserted into a valley portion other than the cymba conchae 309 of the auricle, such as the cavum conchae 310, the vicinity of the tragus 304, the triangular fossa 308, the scaphoid fossa 314, and the like.

Figure 5:
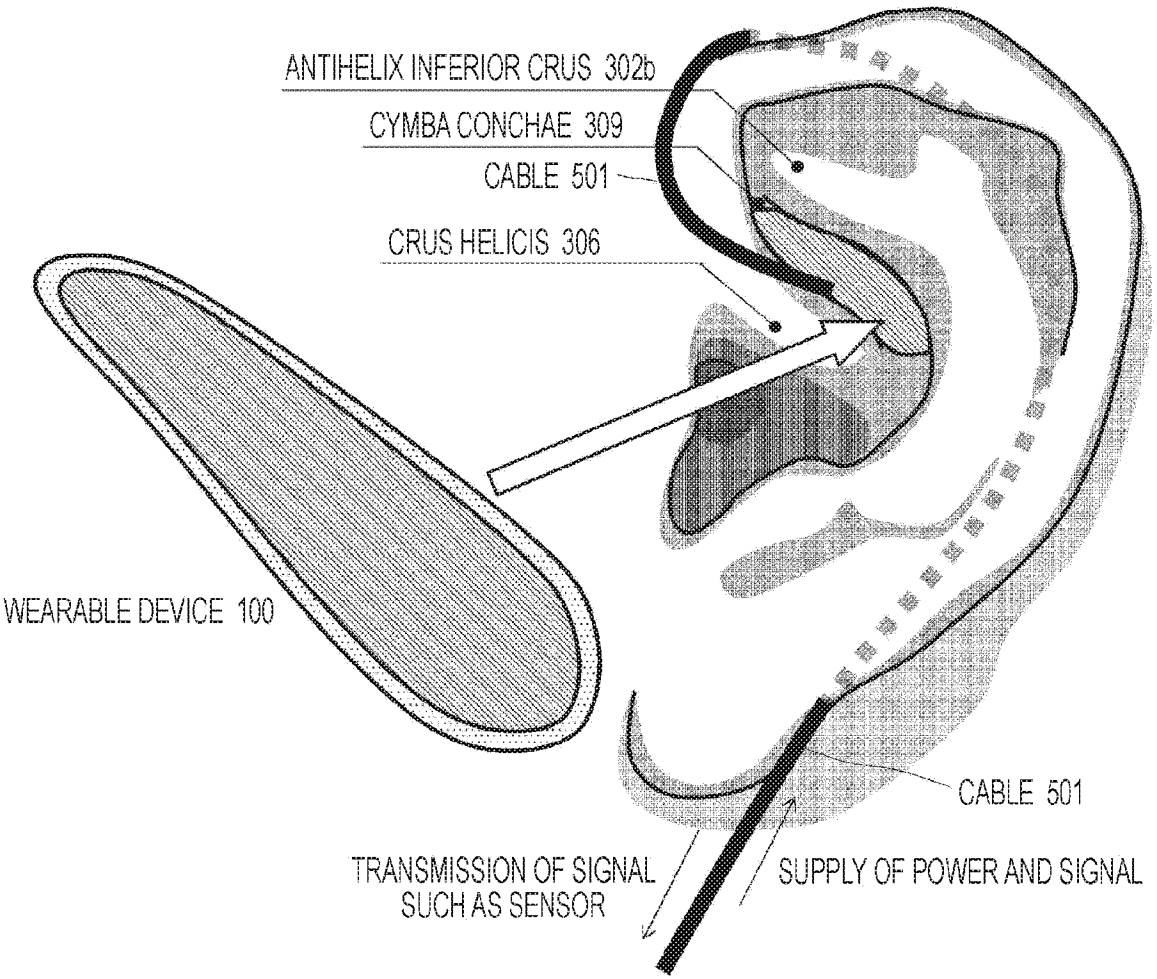
FIG. 5 is a view illustrating a state where the wearable device 100 with a cable is inserted in the cymba conchae.

In addition, FIG. 5 illustrates a state where the wearable device 100 with a cable is inserted in the cymba conchae 309. The main body of the wearable device 100 is formed into an elongated (or streamlined) shape so as to fit the cymba conchae 309 and is held by the auricle so as to be sandwiched between the antihelix inferior crus 302*b* and the crus helicis 306 (same as above). A cable 501 is connected to the vicinity of the center in the longitudinal direction of an outer casing 110 along the side surface of the outer casing 110. Through the cable 501, an external power or signal is supplied to the inside of the wearable device 100, or a signal generated inside the wearable device 100 is output to the outside. However, in a case where a power supply and a circuit board are all incorporated in the wearable device 100, the cable 501 is unnecessary.

In the example illustrated in FIG. 5, a "shure hanging" in which the cable 501 is hung to the ear while passing from the top of the auricle to the back of the ears is carried out. By carrying out the shure hanging, a fitting feeling is increased, the wearable device 100 is less likely to fall off from the auricle, and the cable 501 does not become an obstacle for the user. In addition, even in a case where the cable 501 rubs against clothes of a user and vibrates (in a place not illustrated), it is possible to prevent the vibration from being blocked by a portion that transmits the ear back of the cable 501 and then reaching the ear. In order to facilitate the shure hanging of the cable 501, for example, as illustrated in FIG. 5, it is preferable to connect the cable 501 so as to be along the side surface on the lower side when the outer casing 110 is inserted into the cymba conchae 309.

The main body of the wearable device 100 is formed in an elongated (or streamlined) shape so as to fit the cymba conchae 309; however, it is worried that the wearable device 100 falls off from the auricle, such as when used at the time of jogging. Therefore, an adapter for improving the wearability to the auricle, wearing stability, and adhesion may be used together with the wearable device 100.

Figure 6:
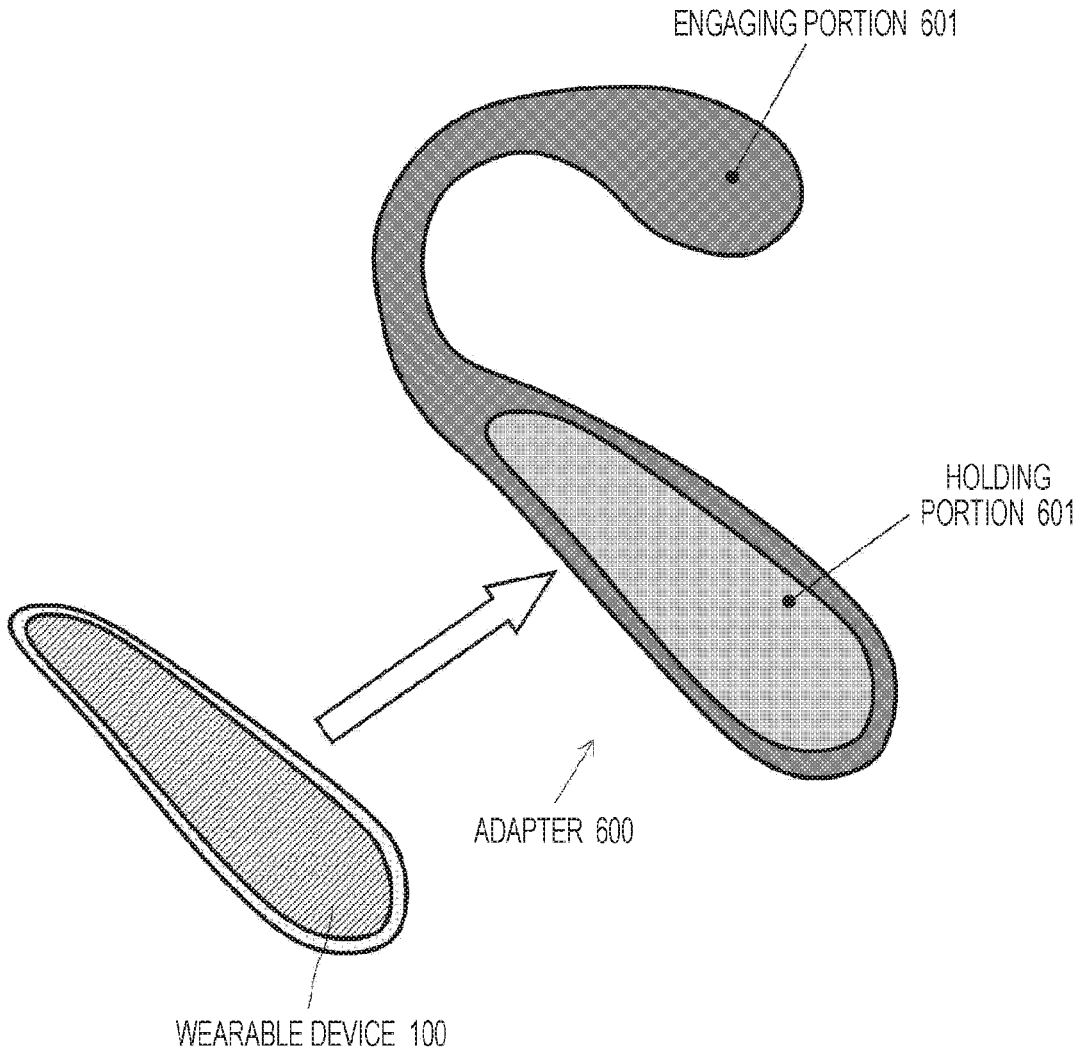
FIG. 6 is a view illustrating a configuration example of an adapter 600.

FIG. 6 illustrates a configuration example of an adapter 600. The illustrated adapter 600 has a substantially U shape, and has a holding portion 601 at one end of the U shape and an engaging portion 602 at the other end. The holding portion 601 has a recessed shape, and the wearable device 100 can be fitted into and held in the recess. The holding portion 601 holding the wearable device 100 is shaped so as to be hung by the cymba conchae 309. On the other hand, the engaging portion 602 has a substantially triangular shape so as to be hung by the triangular fossa 308. The adapter 600 includes a very soft material such as an elastomer, for example, and can be deformed according to the shape of the ear of each individual.

Figure 7:
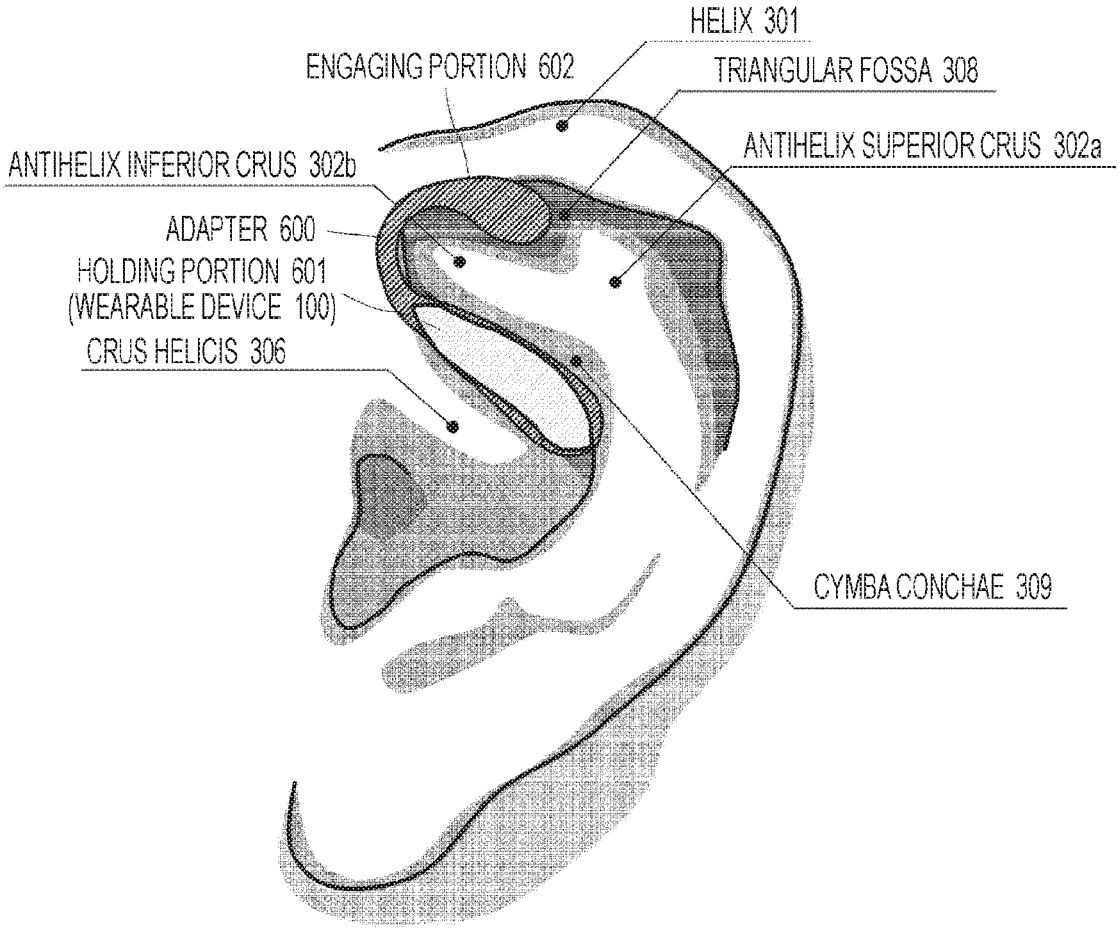
FIG. 7 is a view illustrating a state where the wearable device 100 with an adapter is inserted in a cymba conchae 309.

In addition, FIG. 7 illustrates a state where the wearable device 100 with the adapter 600 is attached to the auricle. The holding portion 601 has a shape conforming to the outer shape of the wearable device 100 by attaching the wearable device 100 to the ring. Then, the holding portion 601 attached with the wearable device 100 is formed into an elongated (or streamlined) shape so as to fit the cymba conchae 309 and is held so as to be sandwiched between the antihelix inferior crus 302*b* and the crus helicis 306. On the other hand, the engaging portion 602 has a substantially triangular shape such that the engaging portion 602 is hung by the triangular fossa 308 and is held so as to be surrounded by three sides by the antihelix superior crus 302*a*, the antihelix inferior crus 302*b*, and the helix 301.

As can be seen from FIG. 7, since the wearable device 100 with the adapter 600 is attached to the auricle by utilizing the two valley portions of the auricle, which are the cymba conchae 309 and the triangular fossa 308, compared to a case where the wearable device 100 is inserted only in the cymba conchae 309, the wearable device 100 can greatly improve the wearability, wearing stability, and adhesion and has a role of dispersing the burden on the user's ears. Further, compared to a case where the wearable device 100 is attached to the auricle by itself, the contact area with the auricle of the wearable device 100 with the adapter 600 becomes larger. Therefore, in a case where the wearable device 100 is used as a sound output device such as an earphone, a transfer characteristic of the sound signal can be improved.

Figure 8:
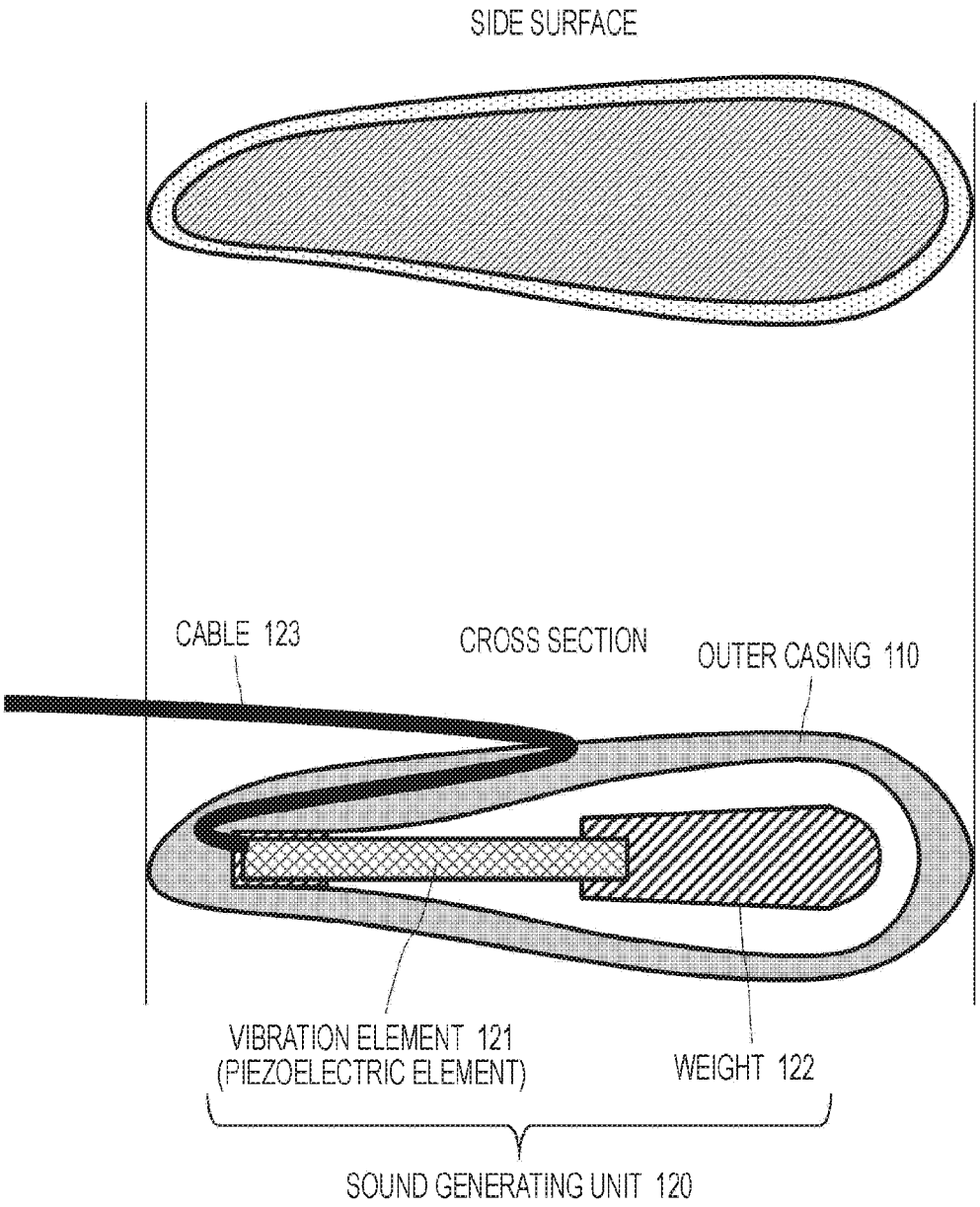
FIG. 8 is a view illustrating aside surface and a cross section (internal configuration example) of the wearable device 100 applied to the earphone.

FIG. 8 illustrates a side surface and a cross section (internal configuration example) of the wearable device 100 applied to the earphone. The illustrated wearable device 100 includes the outer casing 110 and a sound generating unit 120 supported in the outer casing 110.

The outer casing 110 is formed into an elongated (or streamlined) shape so as to fit the cymba conchae 309 formed between the antihelix inferior crus 302*b* and the crus helicis 306 (see FIG. 4). The outer casing 110 is a rigid structure having a certain degree of mechanical strength, which does not deform even when external force that a person grips with a finger is applied thereto, and also has a role of protecting built-in parts such as the sound generating unit 120 from external force. Furthermore, in order to improve the fit feeling with the cymba conchae or to prevent falling off from the cymba conchae 309, the surface of the outer casing 110 may be covered with a flexible cushion portion (not illustrated) such as silicone rubber or may be subjected to a special surface treatment. Furthermore, although not illustrated, the wearable device 100 may be used in combination with an adapter (see above and FIG. 6).

The sound generating unit 120 includes a vibration element 121 and a weight 122. The vibration element 121 has an elongated shape along the longitudinal direction of the outer casing 110, and is a cantilever having only one end fixed to the inner wall of the outer casing 110, and the other end to which a weight 122 is attached, the other hand being an open end.

One end (fixed end) of the vibration element 121 is fixed to the outer casing 110 by bonding, caulking metal, or the like. Further, the weight 122 is a heavy article including a material such as tungsten or brass.

The vibration element 121 includes, for example, a bimorph element. Here, the bimorph element is a flexural vibrator in which two piezoelectric elements that expand and contract in the longitudinal direction are joined or laminated and when one of the piezoelectric elements stretches, the other shrinks, and by applying an alternating electric field to the bimorph element, vibration corresponding to audio is generated. Incidentally, when bending force is applied to the bimorph element in reverse, an alternating electric field can be output.

By disposing the vibration element 121 in the longitudinal direction of the outer casing 110, by making the dimension in the longitudinal direction (cantilever) larger, and by weighting the weight 122, the natural frequency of the vibration element 121 decreases and the sound quality output by the sound generating unit 120 improves. Details of the operation principle of the vibration element 121 will be described later.

Furthermore, by keeping the inner space of the outer casing 110 in a state close to vacuum, it is possible to suppress the loss of sound due to the flow of the internal air.

An audio signal and power to the vibration element 121 are supplied to the inside of the outer casing 110 via a cable 123. However, when the power supply and the circuit board are all incorporated in the outer casing 110, the cable 123 is unnecessary.

Figure 9:
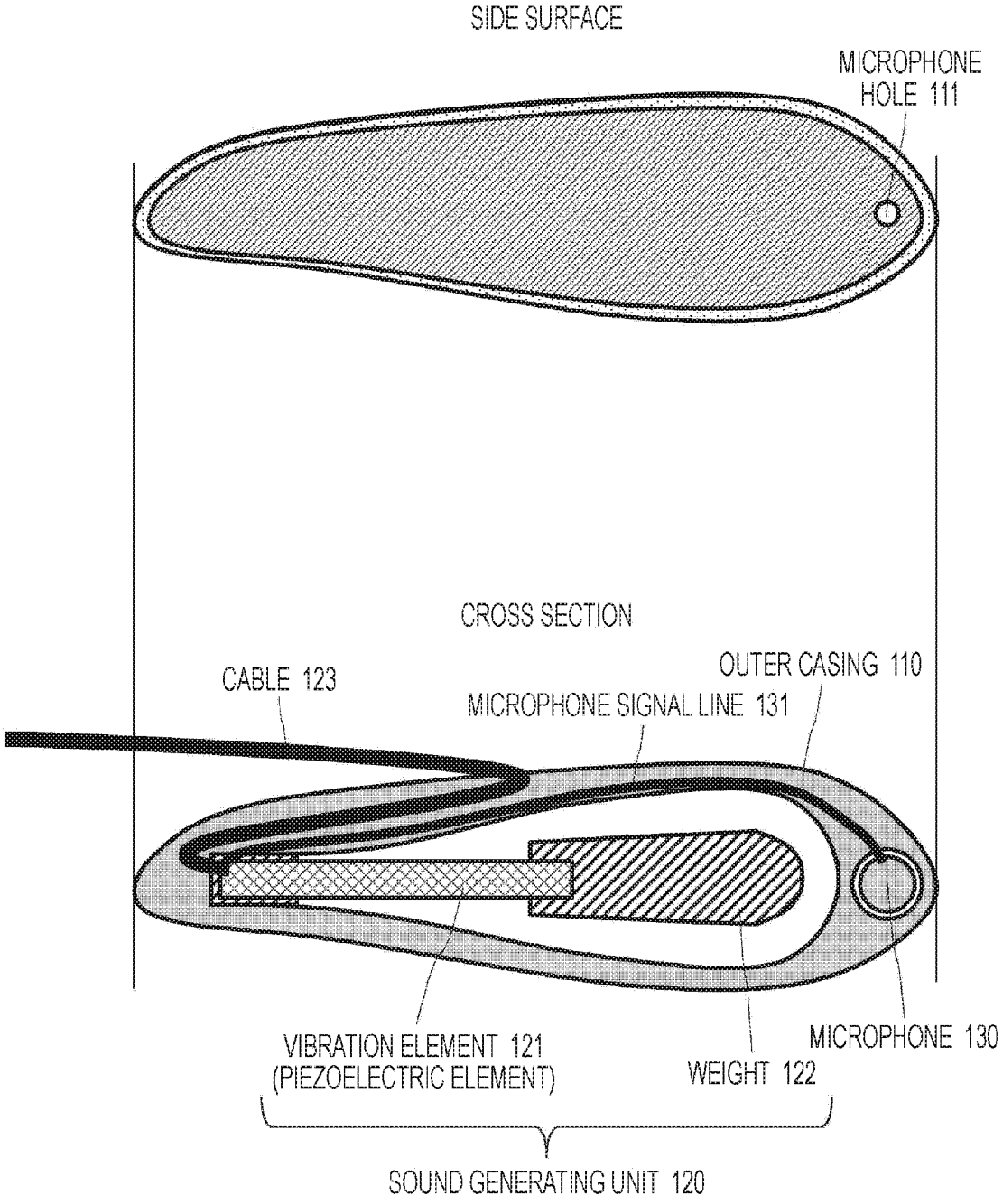
FIG. 9 is a view illustrating aside surface and a cross section (internal configuration example) of the wearable device 100 with a microphone applied to the earphone.

FIG. 9 illustrates a side surface and a cross section (internal configuration example) of the wearable device 100 with a microphone. The illustrated wearable device 100 includes the outer casing 110, the sound generating unit 120 incorporated in the outer casing 110, and a microphone 130.

The outer casing 110 is formed into an elongated (or streamlined) shape so as to fit the cymba conchae 309 formed between the antihelix inferior crus 302*b* and the crus helicis 306. Further, a sound generating unit 920 includes the vibration element 121 and the weight 122. The vibration element 121 includes an elongated shape along the longitudinal direction of the outer casing 110. The one end (fixed end) of the vibration element 121 is fixed to the outer casing 110 by a bond, caulking metal, or the like. The other end of the vibration element 121 is an open end, and a weight 122 including a material such as tungsten or brass is attached to the other end (same as above).

The microphone 130 that collects audio is attached near a distal end of the outer casing 110. The audio signal collected by the microphone 130 is transmitted through the outer casing 110 vie a microphone signal line 131 and further externally output from the cable 123. Further, on the wall surface of the outer casing 110, a microphone hole 111 is drilled in accordance with the installation place of the microphone 130. The ambient audio reaches the microphone through this microphone hole 130.

An example of the application of the microphone 130 is noise canceling. That is, noise is reduced by picking up a surrounding sound with the microphone 130 and generating a sound wave in a phase just opposite to the sound. It is possible to use the microphone 130 as a feed-forward type or feedback type noise canceling microphone. By equipping the wearable device 100 with the microphone 130, it is possible to realize noise canceling at a place closer to the eardrum.

Note that the wearable device 100 may also be equipped with sensors other than the microphone described above. Various biological sensors and detachable sensors may be mounted on the wearable device 100 by utilizing a property that the wearable device 100 is used in contact with the human body.

Next, the operation principle of the sound generating unit 120 will be described.

Figure 10:
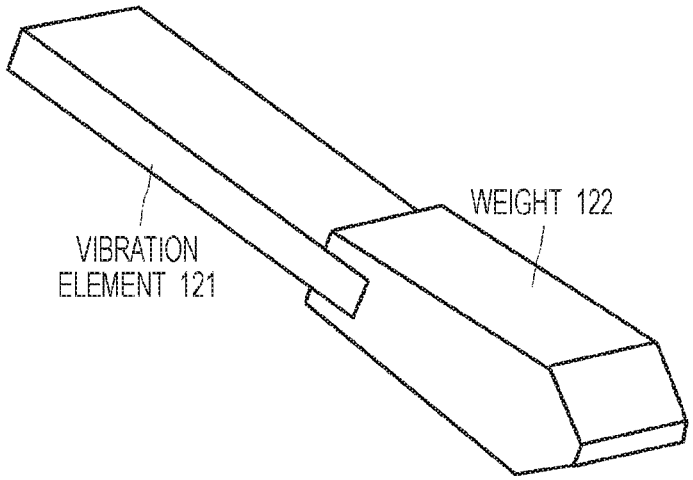
FIG. 10 is a view illustrating a perspective view of a sound generating unit 120 including a vibration element 121 and a weight 122.

FIG. 10 illustrates a perspective view of the sound generating unit 120. As described above, the sound generating unit 120 includes the vibration element 121 and the weight 122.

The vibration element 121 includes, for example, a bimorph element. The bimorph element is a flexural vibrator in which two piezoelectric elements that expand and contract in the longitudinal direction are joined or laminated vertically and when one of the piezoelectric elements stretches, the other shrinks, and by applying an alternating electric field to the bimorph element, vibration corresponding to audio can be generated.

Figure 11:
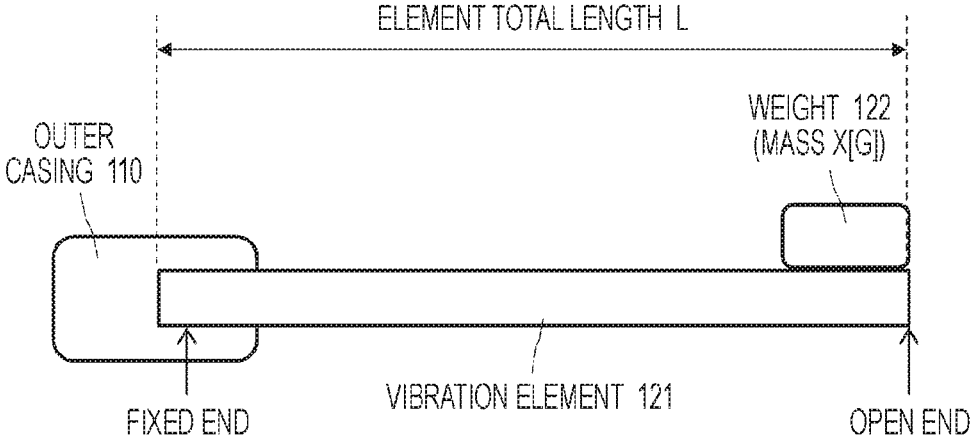
FIG. 11 is a view exemplifying a stationary state of the vibration element 121 in which a weight having a mass X[g] is placed on an open end.

FIG. 11 exemplifies a stationary state of the vibration element 121 in which one end is a fixed end, the other end is an open end, and a weight having amass X[g] is placed on the open end. No electric field is applied to the two upper and lower piezoelectric elements constituting the vibration element 121, (or, an electric field is given so that the expansion and contraction of each piezoelectric element is about the same), and the vibration element 121 does not bend but extends substantially straight in the horizontal direction.

Figure 12:
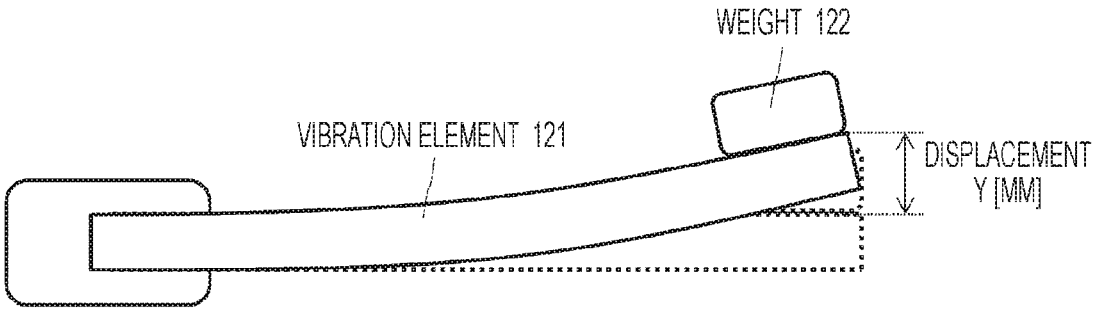
FIG. 12 is a view exemplifying a driving state of the vibration element 121.

In addition, FIG. 12 exemplifies the driving state of the vibration element 121. In FIG. 12, an electric field in which of the two piezoelectric elements constituting the vibration element 121, the lower side stretches and the upper side shrinks is applied, and as a result, the vibration element 121 bends upward and the open end is displaced upward by Y [mm] from a horizontal position.

Figure 13:
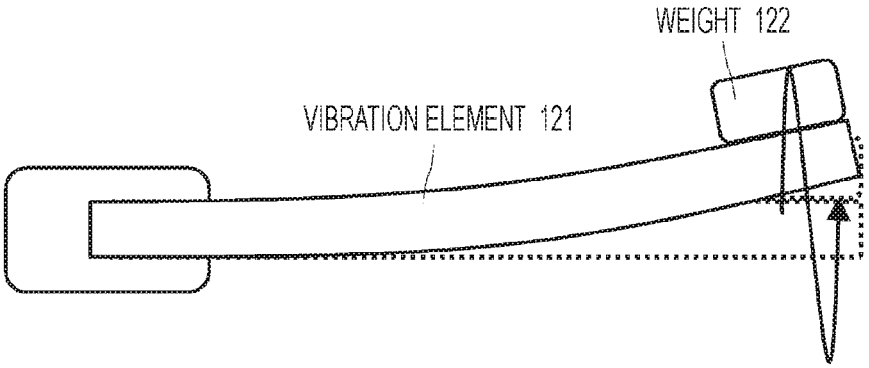
FIG. 13 is a view exemplifying how the open end of the vibration element 121 vibrates.

When an alternating electric field is applied to the vibration element 121, the two piezoelectric elements alternately progress and contract, and as illustrated in FIG. 13, an open end side to which the weight 122 is attached vibrates in a vertical direction of a page.

A lowest resonance frequency (F0) of the vibration element 121 is determined by an element total length L and a mass X[g] of the weight 122 attached to the open end. Therefore, in order for the sound generating unit 120 to secure a wider audio output frequency band, it is preferable to use the vibration element 121 as long as possible and the heavy weight 122. Further, if the outer casing 110 supporting the vibration element 121 in a cantilever structure includes a material such as metal having a heavy weight, it is considered to contribute to securing a low frequency band.

In the example illustrated above, since the vibration element 121 is disposed along the longitudinal direction of the elongated outer casing 110, the element length can be made as long as possible. Then, the vibration element 121 includes, for example, a bimorph element, and is flexed in the vertical direction (a direction perpendicular to the longitudinal direction of the outer casing 110) to vibrate. It can be said that it is easy to support the vibration element 121 which is a cantilever if the outer casing 110 is formed in an elongated shape. In other words, it can be said that lengthening the element length of the vibration element 121 makes it easier to output low-frequency audio, but it is easier to cancel noise by that much.

Figure 14:
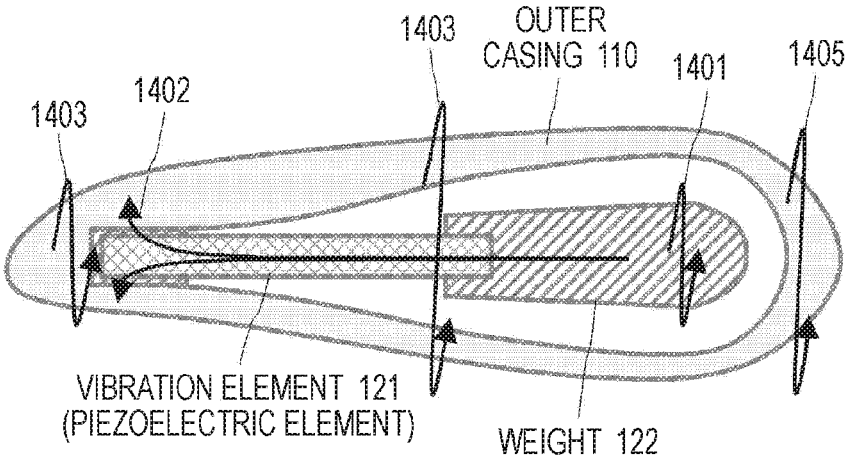
FIG. 14 is a view exemplifying a manner in which the entire wearable device 100 vibrates by driving the vibration element 121.
Figure 25:
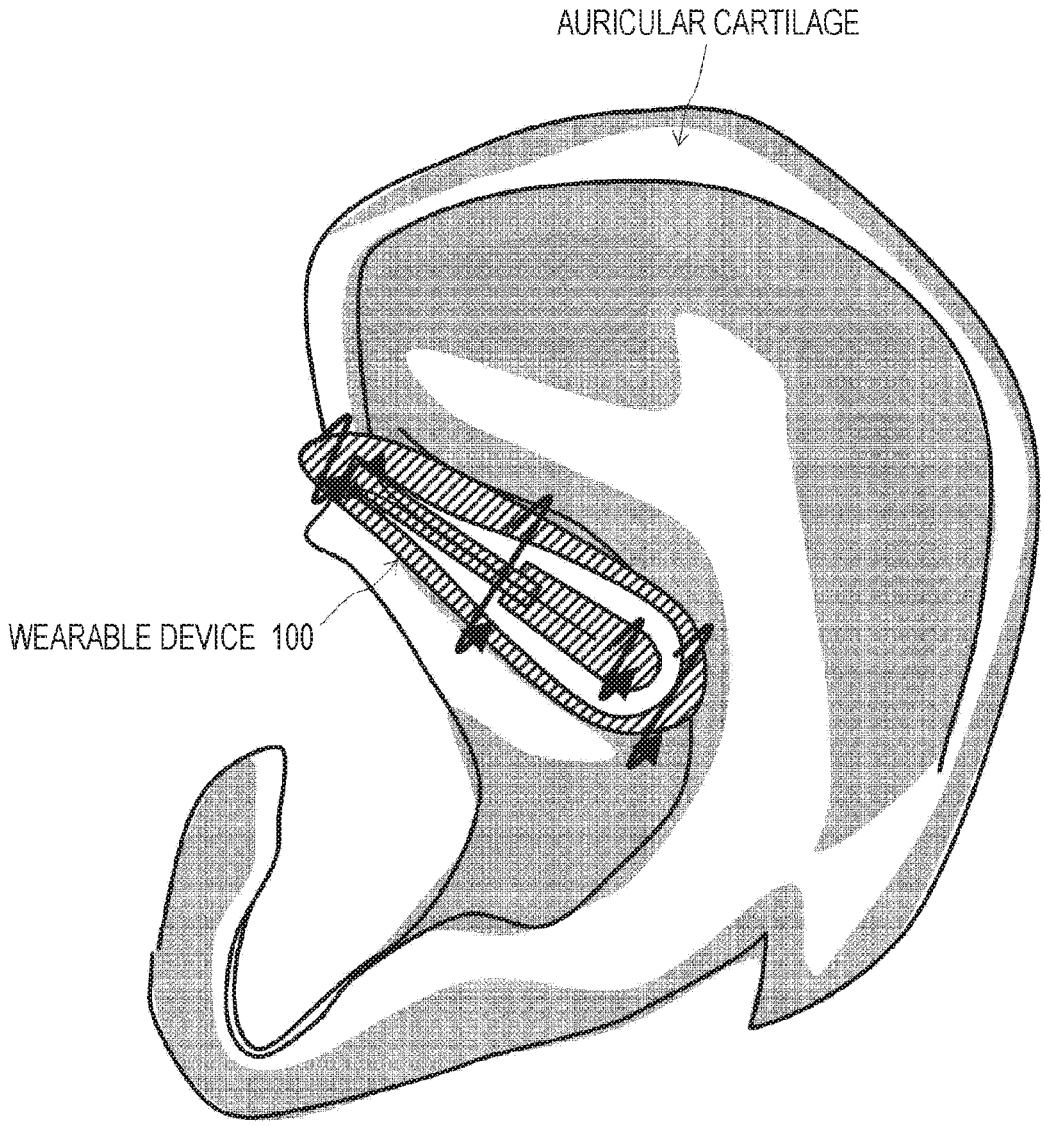
FIG. 25 is a view illustrating how the wearable device 100 inserted into the cymba conchae vibrates an auricular cartilage.

FIG. 14 exemplifies a manner in which the entire wearable device 100 vibrates by driving the vibration element 121. When vibration of the weight 122 indicated by reference numeral 1401 propagates to the outer casing 110 as indicated by reference numeral 1402 according to the principle of action and reaction, as indicated by reference numerals 1403 to 1405, the vibration of the weight 122 becomes vibration of the outer casing 110. These vibrations 1403 to 1405 are transmitted to the skin and auricular cartilage forming the cymba conchae. FIG. 25 illustrates how the wearable device 100 inserted into the cymba conchae vibrates the auricular cartilage. By the vibration transmitted to the auricular cartilage, it is possible to transmit a sound signal by further shaking the eardrum and the middle ear. It should be noted that the amplitude of the vibrations 1403 to 1405 of the vibration element 121 needs to be designed to keep a clearance so that the vibration element 121 itself and the weight 122 do not strike the inner wall of the outer casing 110.

In the wearable device 100 according to the first embodiment, rather than converting an electric signal into air vibration (sound wave), the vibration element 121 transmits the mechanical vibrations 1403 to 1405 of the vibration element 121 as it is to the human body (bone conduction). Then, when a human body becomes a secondary sound producing body and transmits sound to the air (more specifically, the vibration transmitted through the human body to the wall of the ear canal (cartilage region) is converted into air vibration), the vibration reaches the eardrum.

From the viewpoint of transmitting the vibration to the human body, it is preferable that the outer casing 110 has an elongated shape and a contact area with the human body (cymba conchae) is as wide as possible. The outer casing 110 is not simply formed into an elongated shape but is formed to have a gently curved shape along the anthelix; accordingly, it can be said that the contact area with the auricle is further widened and the vibration of the vibration element 121 is easily transmitted to the human body.

Since the wearable device 100 according to the first embodiment itself does not convert an electric signal into air vibration, it is unnecessary to provide an opening such as a sound guiding tube or a sound hole propagating a sound wave. Therefore, it is possible to configure the wearable device 100 (or the outer casing 110) into a complete waterproof structure by complete sealing. In addition, the wearable device 100 according to the first embodiment does not fall into a situation in which the sound hole is blocked by earwax or the like and the wearable device 100 cannot be used, is maintenance free and easy to clean. However, it should be noted that the wearable device 100 with a microphone requires a microphone hole (see, for example, FIG. 9) and cannot be configured as complete sealing.

In addition, since the wearable device 100 according to the first embodiment uses the vibration element 121 including a piezoelectric element or the like, there is an advantage that power saving is possible on the basis of the following reasons (1) to (3).

(1) The piezoelectric element appears as a capacitor, as a circuit element; therefore, no direct current flows therethrough.

(2) The piezoelectric element flows a high frequency (alternating current) in an audible range, but a speaker using the piezoelectric element is more power-saving than a dynamic speaker.

(3) High frequency response is relatively high, and power saving can be achieved by suppressing output by signal processing.

Here, a lowest resonance frequency of the vibration element 121 is determined by an element total length L and a mass X[g] of the weight 122 attached to the open end. Therefore, in order for the sound generating unit 120 to secure a wider audio output frequency band, it is preferable to use the vibration element 121 as long as possible and the heavy weight 122.

Figure 15:
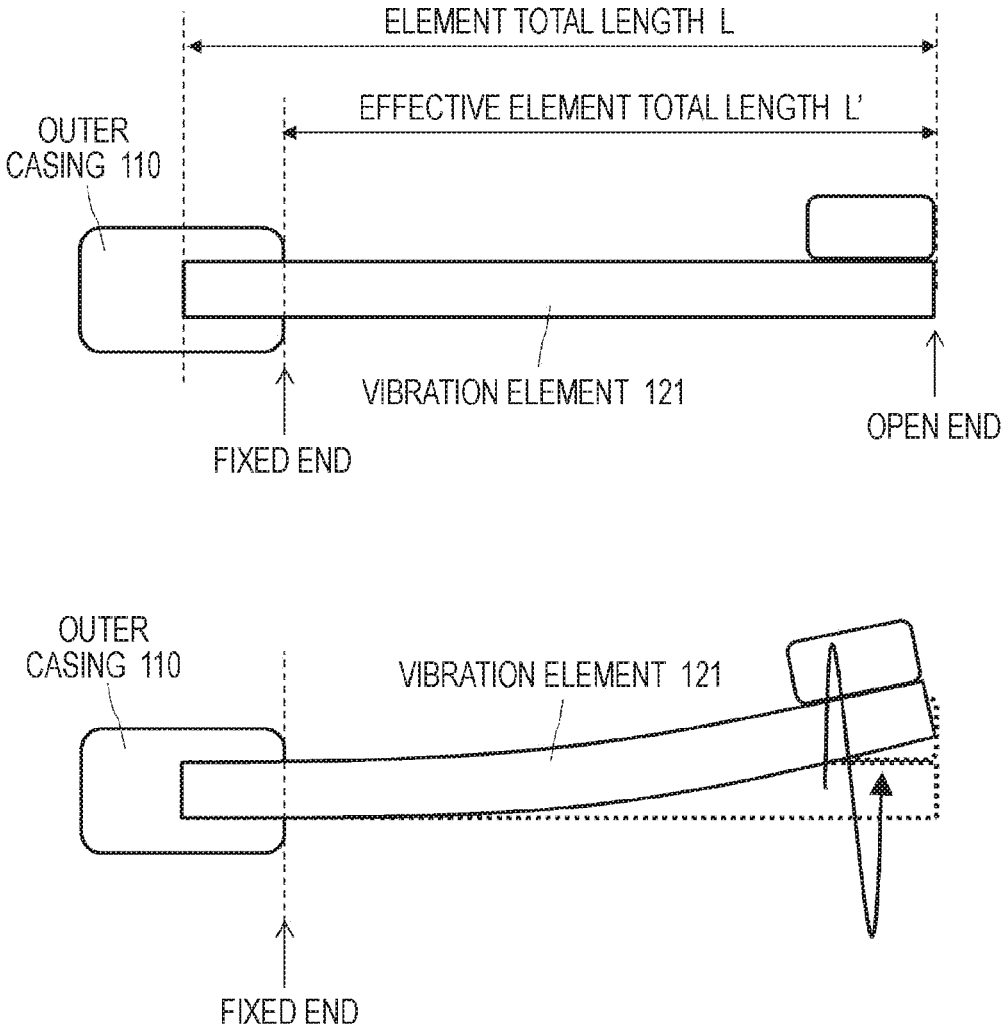
FIG. 15 is a view exemplifying a method of attaching the vibration element 121 to an outer casing 110.

However, as illustrated in FIG. 15, when one end of the vibration element 121 is fixed to the outer casing 110 in a rigid manner, since an attaching margin portion of the vibration element 121 is buried in the inner wall of the outer casing 110 and does not vibrate at all, an effective element total length L' (a length from the open end to the fixed end) becomes shorter than the element total length L by the length of the attaching margin, and the audio output frequency band becomes narrower by that much.

Figure 16:
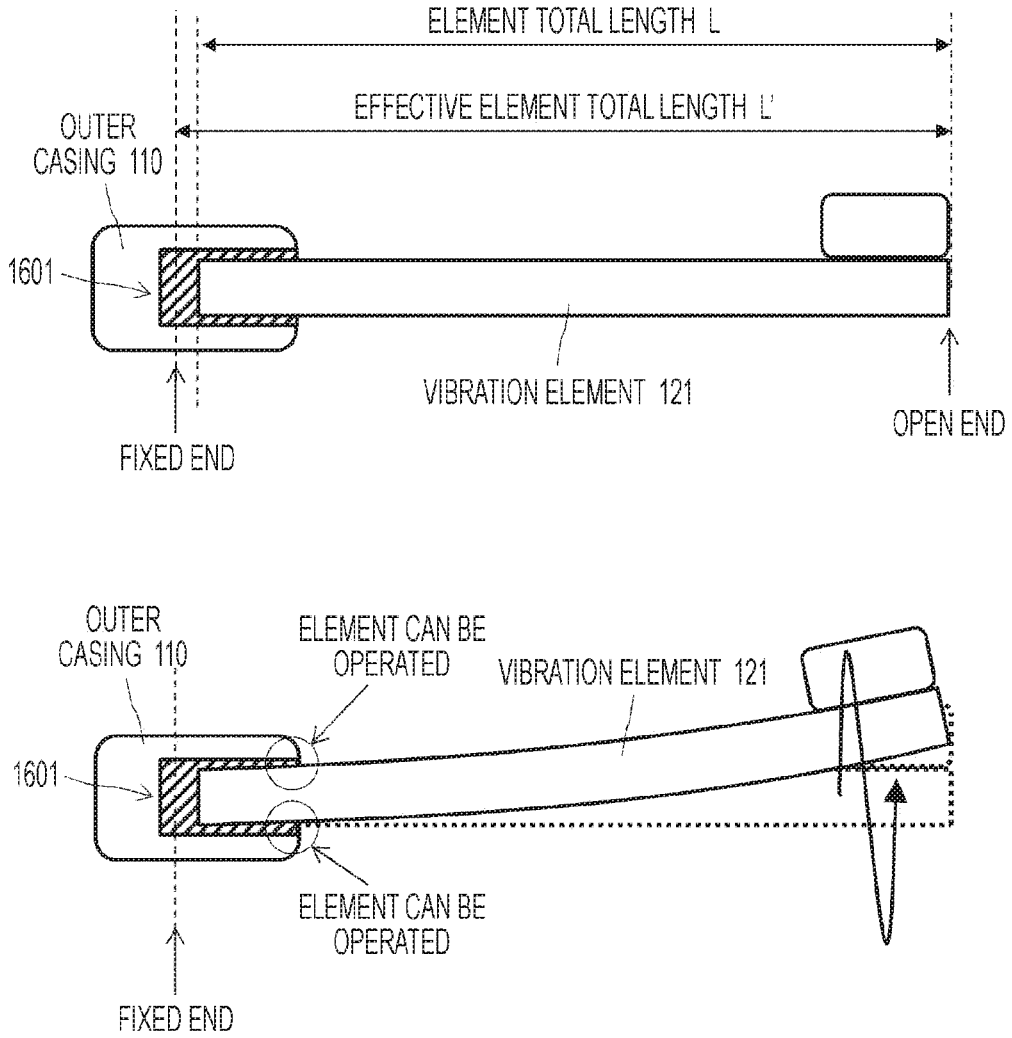
FIG. 16 is a view exemplifying a method of attaching the vibration element 121 to the outer casing 110.

FIG. 16 illustrates an example in which one end of the vibration element 121 is attached to the outer casing 110 by being so-called semi-fixed via an elastic material such as a bond 1601. In such a case, since the vibration element 121 can also be operated in the attaching margin portion, the effective element total length L' (a length from the open end to the fixed end) is not shortened as compared with the example illustrated in FIG. 15. Rather, the effective element total length L' maybe longer than the total length L of the vibration element 121.

Figure 17:
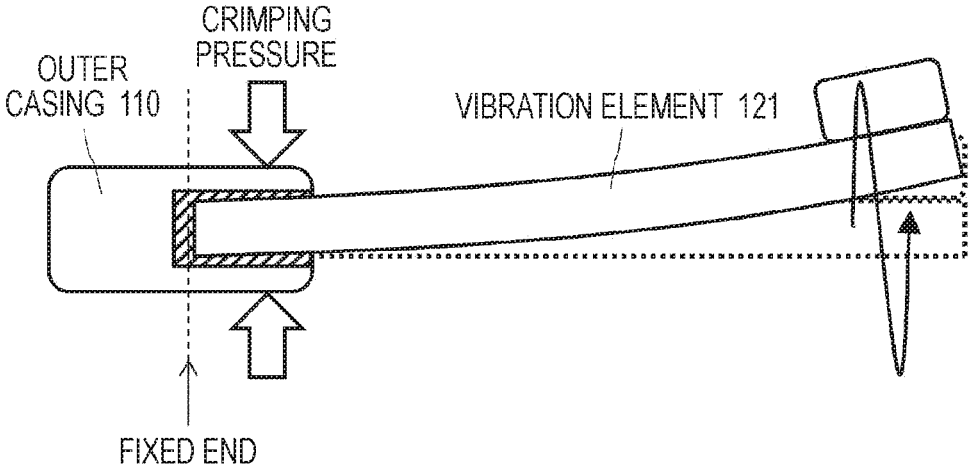
FIG. 17 is a view exemplifying a method of attaching the vibration element 121 to the outer casing 110.
Figure 18:
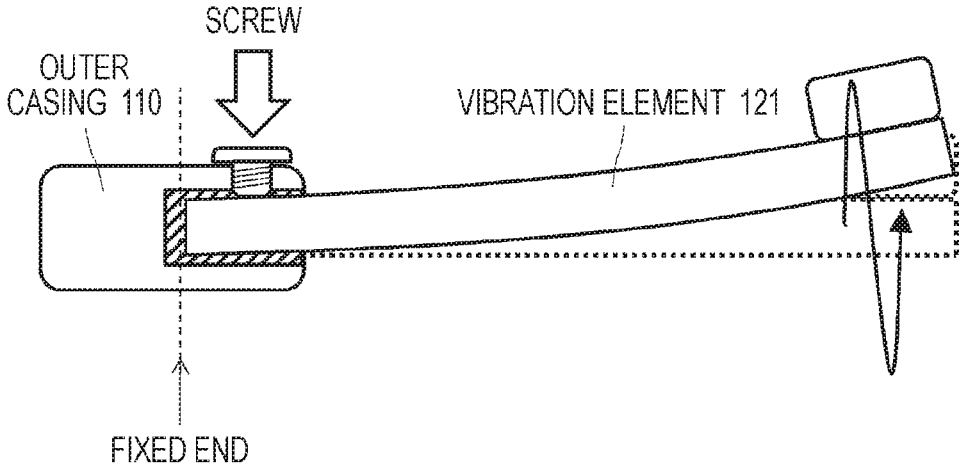
FIG. 18 is a view exemplifying a method of attaching the vibration element 121 to the outer casing 110.

Note that in the method of attaching one end of the vibration element 121 to the outer casing 110 with the bond 1601 as illustrated in FIG. 16, since the position of the fixed end varies due to a bonding state of the bond 1601 and the effective element total length L' is not constant, there is a problem that the lowest resonance frequency changes (sound quality is not stabilized). Therefore, a caulking pressure may be adjusted so as to be a prescribed minimum resonance frequency at the time of, for example, manufacturing and shipping by adopting a structure (see FIG. 17) in which the crimping pressure of the fixed portion of the vibration element 121 can be adjusted, and a structure in which one end of the vibration element 121 is screwed (see FIG. 18). Alternatively, the variation of the lowest resonance frequency may be corrected by signal processing or the like.

Figure 19:
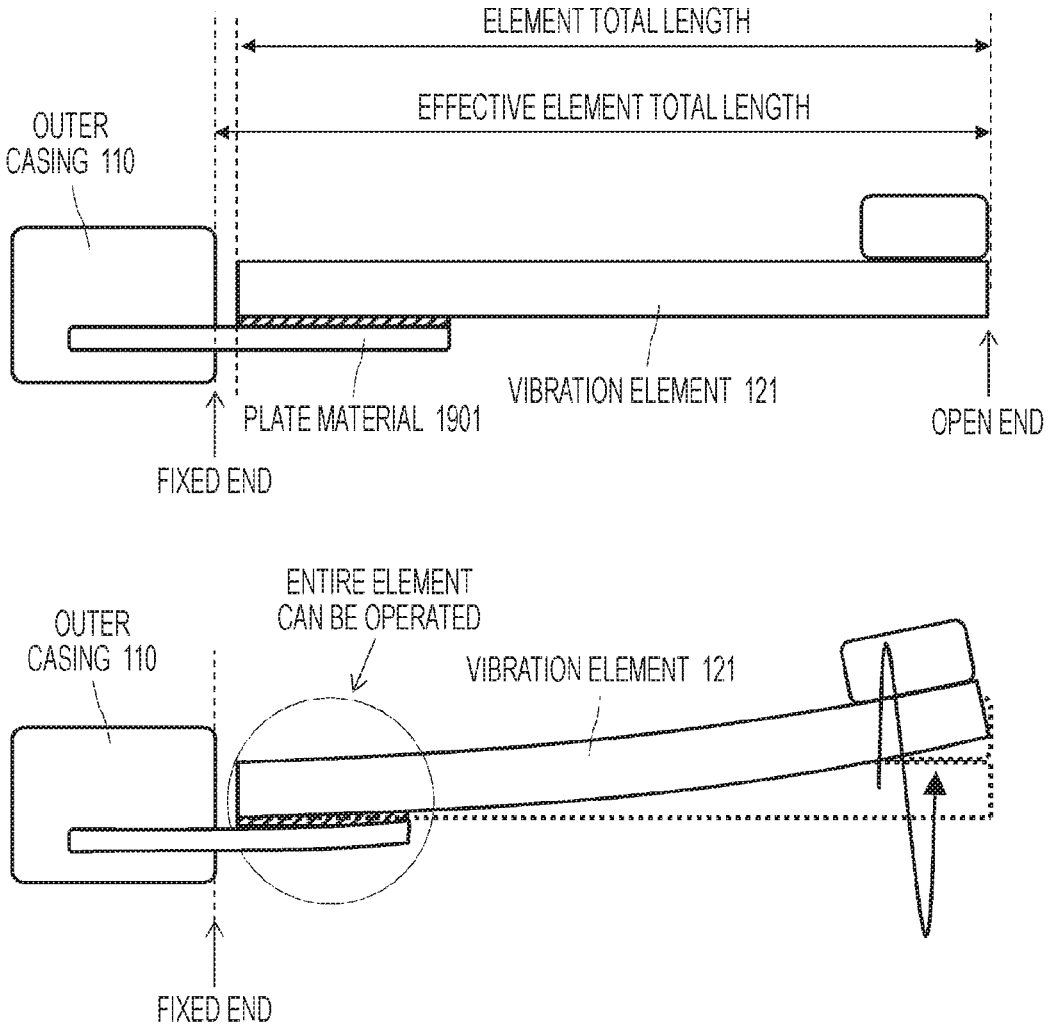
FIG. 19 is a view exemplifying a method of attaching the vibration element 121 to the outer casing 110.

In addition, FIG. 19 illustrates an example in which one end of the vibration element 121 is attached to the outer casing 110 via a plate material 1901. Although the plate material 1901 is fixed to the inner wall of the outer casing 110 in a rigid manner, the vibration element 121 is in a state of being operated over the entire length. In such a case, the effective element total length L' (a length from the open end to the fixed end) of the vibration element 121 is longer than the total length L of the vibration element 121 by the interposition of the plate material 1901. Note that it is preferable that the plate material 1901 is a material such as a thin stainless steel sheet which is flexible and resistant to mechanical fatigue.

In other words, according to the wearable device 100 according to the first embodiment, there is an advantage that restrictions on the sound generating element 120 are small except for the element total length L (or the effective element total length L') of the vibration element 121 and the mass of the weight 122, and the degree of freedom of shape design is high. On the other hand, in the case of a speaker of a type in which air is vibrated by a diaphragm, a disk-shaped diaphragm has a shape dependence such that sound quality is more stable and it is easier to manufacture, which is a design restriction.

[Second Embodiment ]

Figure 20:
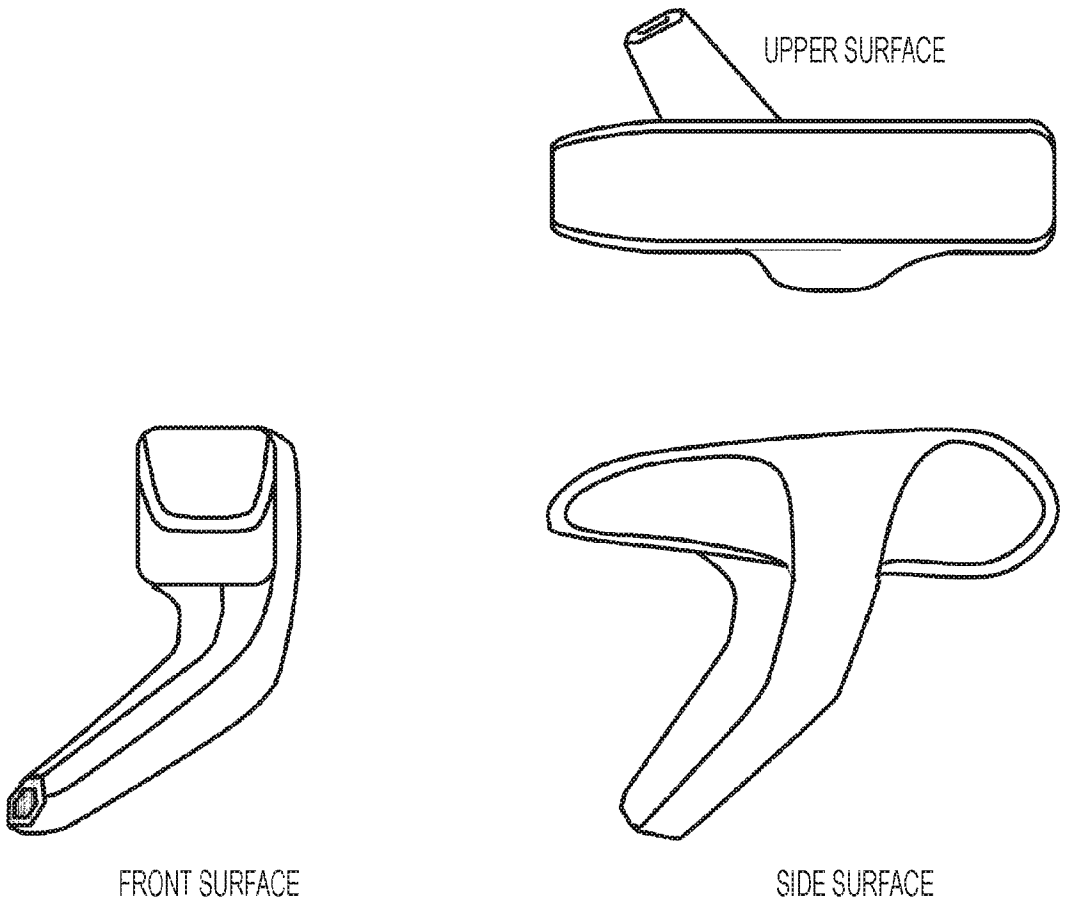
FIG. 20 is a view illustrating an external configuration of a wearable device 200 according to a second example of the technology disclosed in this specification.
Figure 21:
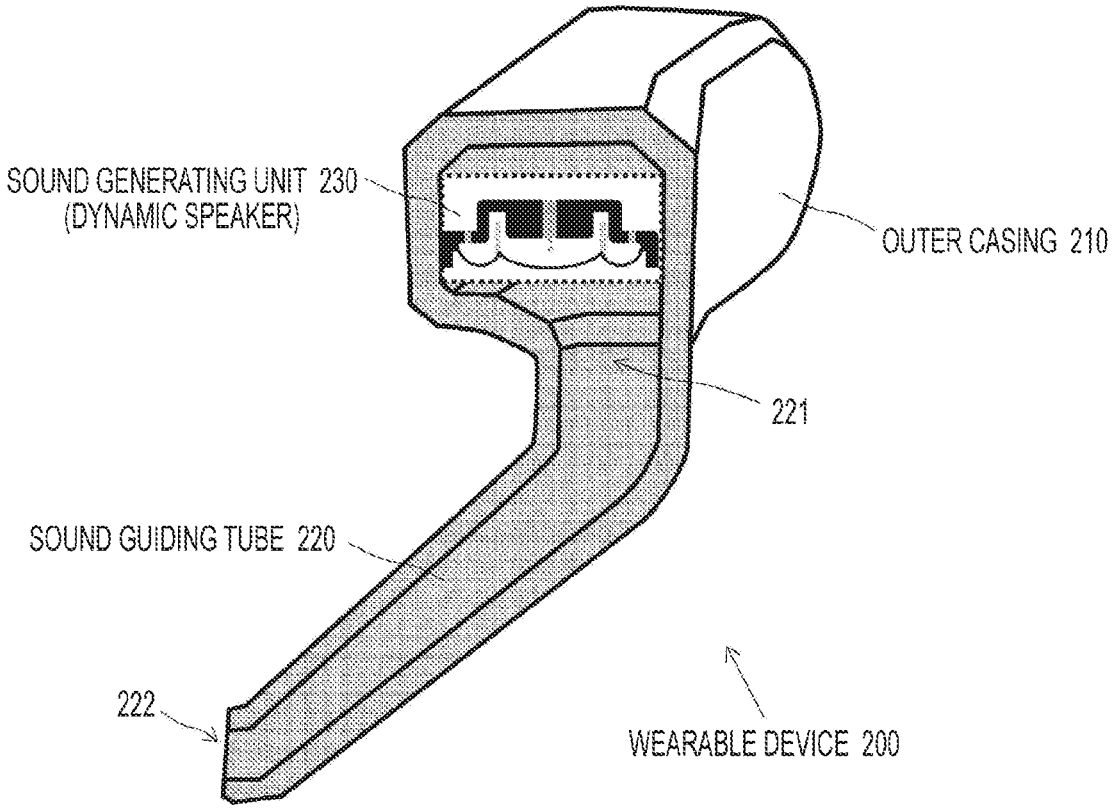
FIG. 21 is a view illustrating an internal configuration example in a case where the wearable device 200 is applied as a sound output device.

FIG. 20 illustrates an external configuration of a wearable device 200 according to a second embodiment of the technology disclosed in this specification. However, FIG. 20 is a three-view diagram in which the wearable device 200 with a microphone is viewed from a front surface, an upper surface, and a side surface. In addition, FIG. 21 illustrates an internal configuration example in a case where the wearable device 200 is applied as a sound output device.

The wearable device 200 according to the second embodiment uses a dynamic speaker as a sound generating unit 230 and includes an outer casing 210 that internally supports the dynamic speaker, and a sound guiding tube 220 that propagates the sound wave generated by the dynamic speaker to the outside.

The outer casing 210 has a streamlined shape or an elongated shape, and can be used by being inserted into any valley portion of the auricle, such as, for example, a cymba conchae, a cavum conchae, a tagus vicinity, a triangular fossa, a scaphoid fossa or the like. The outer casing 210 is a rigid structure having a certain degree of mechanical strength, which does not deform even when external force that a person grips with a finger is applied thereto, and also has a role of protecting built-in parts such as the sound generating unit 230 from external force.

The sound guiding tube 220 propagates the sound wave generated by the sound generating unit (dynamic speaker) 230 from the installation place of the outer casing 210 to the vicinity of the ear canal entrance and radiates the sound wave toward the back of the ear canal (eardrum). The sound guiding tube 220 is joined to the outer casing 210 at one end 221 thereof. In addition, the sound guiding tube 220 has a gently curved shape, and the other end 222 of the sound guiding tube 220 reaches near the ear canal entrance when the outer casing 210 is inserted into the cymba conchae.

The outer casing 210 has an elongated shape because the outer casing 210 is used by being inserted into the cymba conchae. On the other hand, in a case where a dynamic speaker is used as the sound generating unit 230, there is a shape dependence that it is better to make the diaphragm into a disk shape due to sound quality and manufacturing convenience. Therefore, it is thought that it is preferable to dispose the sound generating unit 230 in the outer casing 210 as illustrated in FIG. 21 so that the diaphragm can be made as large as possible. Further, according to the disposition of the sound generating unit 230 illustrated in FIG. 21, a sound wave can be generated toward the sound guiding tube 220.

Figure 22:
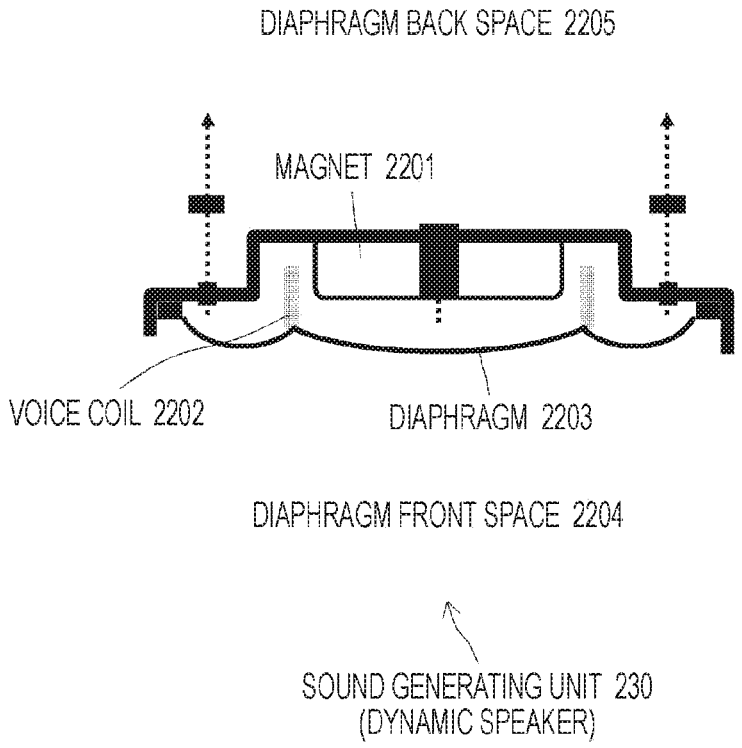
FIG. 22 is a view illustrating a structure of a dynamic speaker as a sound generating unit 230.

FIG. 22 illustrates in detail a structure of the dynamic speaker as the sound generating unit 230.

A diaphragm 2203 having a voice coil 2202 is disposed so as to face a magnetic circuit constituted by a magnet 2201. Furthermore, the interior of the sound generating unit 230 is partitioned by the diaphragm 2203 into a diaphragm front space (front cavity) 2204 and a diaphragm back space 2205 (back cavity). Then, when the magnetic field changes according to the audio signal input to the voice coil 2202, the diaphragm 2203 moves back and forth according to the magnetic force of the magnet 2201, so that change in atmospheric pressure occurs between the diaphragm front space 2204 and the diaphragm back space 2205, which becomes sound.

The sound generated in the diaphragm front space 2204 is taken into the one end 221 of a sound guiding portion 220. At this time, the sound propagates through the tube, is radiated from the other end 222 of the sound guiding portion 220 toward the back of the ear canal, and then reaches the eardrum.

Therefore, the one end 221 of the sound guiding tube 220 is joined to the outer casing 210 near the diaphragm front space 2204. In addition, the sound guiding tube 220 has a gently curved shape so that the other end 222 reaches near the ear canal entrance when the outer casing 210 is inserted into the cymba conchae.

It is to be noted that a sound generating element of the sound generating unit 230 may be any one of balanced armor type, condenser type, piezoelectric type, electrostatic type, or a combination of two or more, in addition to the above dynamic type.

The wearable device 200 according to the second embodiment illustrated in FIG. 20 and FIG. 21 can be used by being inserted into the cymba conchae 309, for example, similar to the wearable device 100 according to the first embodiment. The cymba conchae 309 is an elongated valley (space) formed between two parts of the antihelix inferior crus 302*b* and the crus helicis 306 (see FIG. 3).

Figure 23:
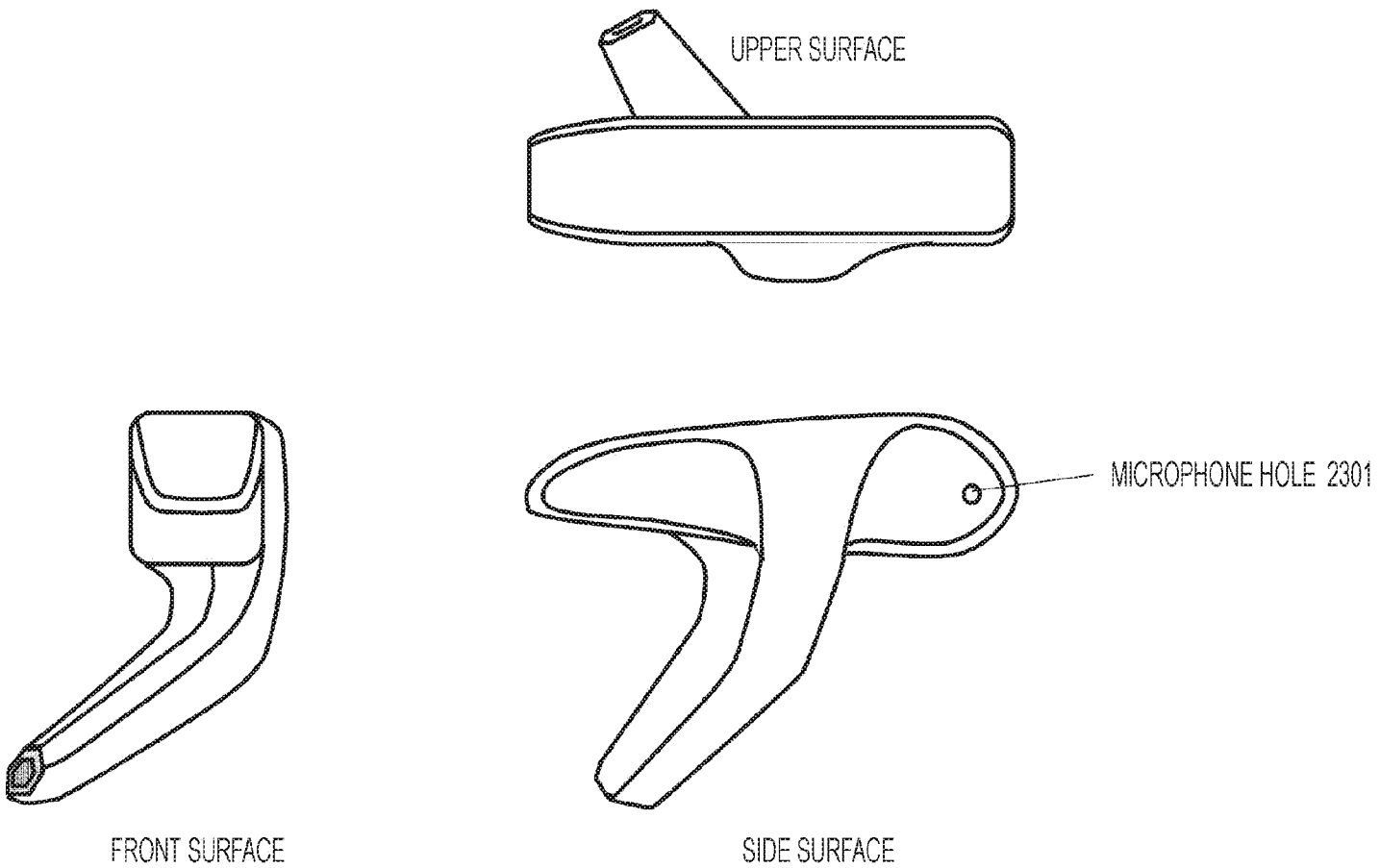
FIG. 23 is a view illustrating a three-view diagram in which the wearable device 200 with a microphone is viewed from a front surface, an upper surface, and a side surface.

Note that FIG. 23 illustrates a three-view diagram in which the wearable device 200 with a microphone (not illustrated) is viewed from a front surface, an upper surface, and a side surface. It is assumed that the microphone is supported inside the outer casing. As illustrated in FIG. 23, on the wall surface of the outer casing, a microphone hole 2301 is formed in accordance with the installation place of the microphone. The audio reaches the microphone through this microphone hole 2301.

An example of the application of the microphone is noise canceling. That is, noise is reduced by picking up a surrounding sound with the microphone and generating a sound wave in a phase just opposite to the sound. It is possible to use the microphone as a feed-forward type or feedback type noise canceling microphone. By equipping the wearable device 200 with the microphone, it is possible to realize noise canceling at a place closer to the eardrum.

Note that the wearable device 200 may also be equipped with sensors other than the microphone described above. Various biological sensors and detachable sensors may be mounted on the wearable device 100 by utilizing a property that the wearable device 200 is used in contact with the human body.

Figure 24:
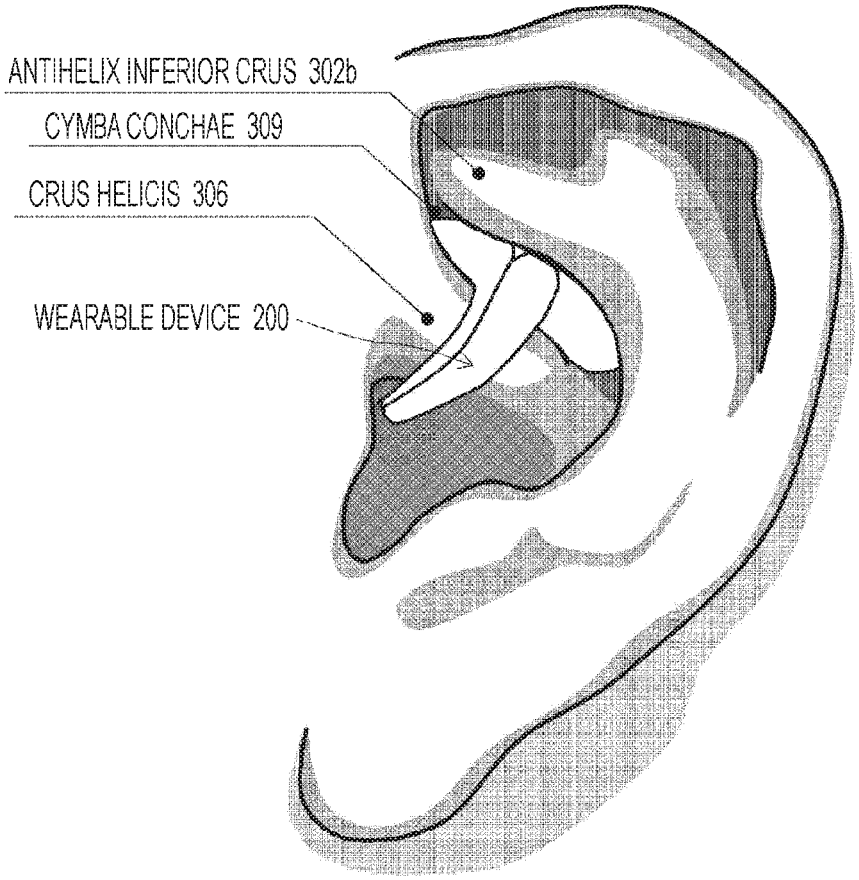
FIG. 24 is a view illustrating a state where the wearable device 200 is inserted in the cymba conchae 309.

FIG. 24 illustrates a state where the wearable device 200 is inserted into the cymba conchae 309. The main body of the wearable device 200 is formed into an elongated (or streamlined) shape so as to fit the cymba conchae 309 and is held by the auricle so as to be sandwiched between the antihelix inferior crus 302*b* and the crus helicis 306. In addition, the sound wave generated by the sound generating unit 230 (dynamic speaker) is transmitted along the sound guiding tube 220 and is radiated to near the ear canal entrance.

In order to improve the fit feeling with the cymba conchae or to prevent falling off from the cymba conchae 309, the surface of the outer casing 210 may be covered with a flexible cushion portion (not illustrated) such as silicone rubber or may be subjected to a special surface treatment. Furthermore, although not illustrated, like the wearable device 100 according to the first embodiment, the wearable device 200 may be used in combination with an adapter (see FIG. 6).

It is to be noted that as a modification, the wearable device 200 can be configured so as to be inserted into a valley portion other than the cymba conchae of the auricle, such as the cavum conchae, the tagus vicinity, the triangular fossa, the scaphoid fossa, and the like.

Figure 26:
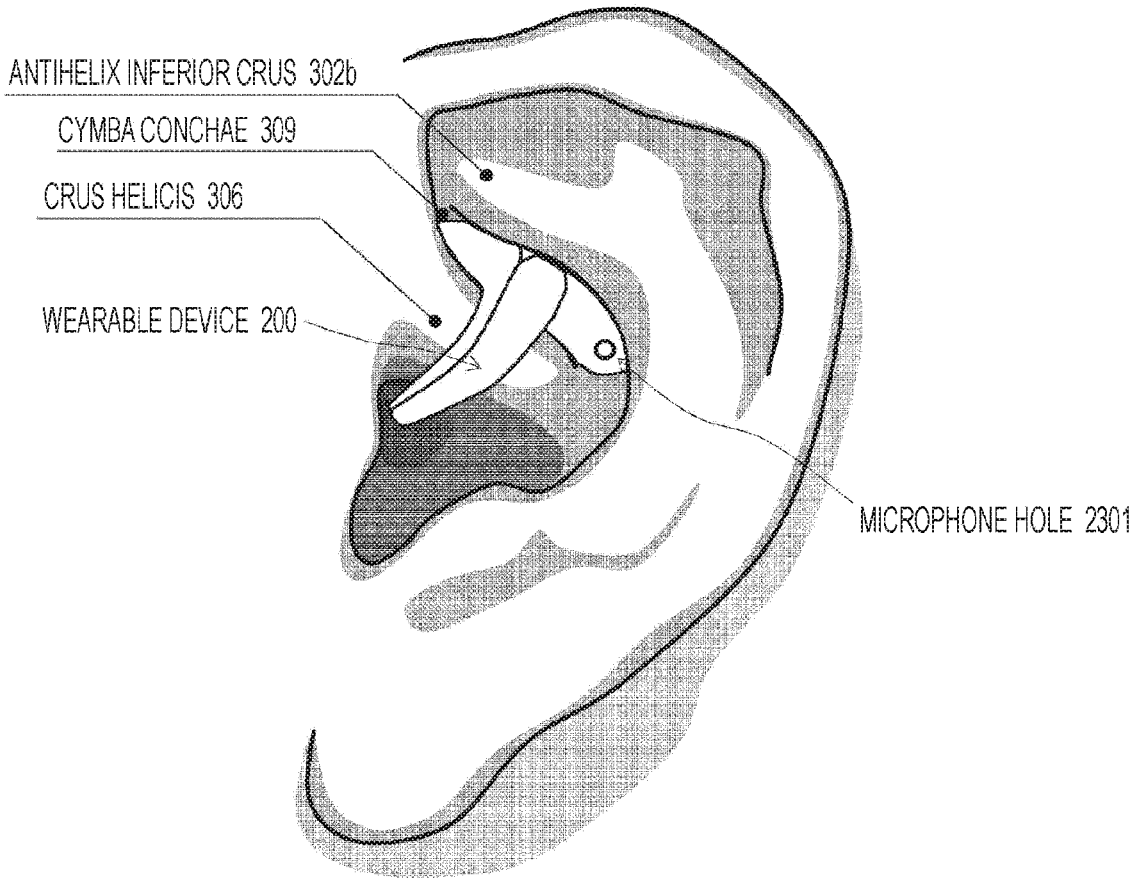
FIG. 26 is a view illustrating a state where the wearable device 200 having a microphone hole is inserted in the cymba conchae 309.
Figure 27:
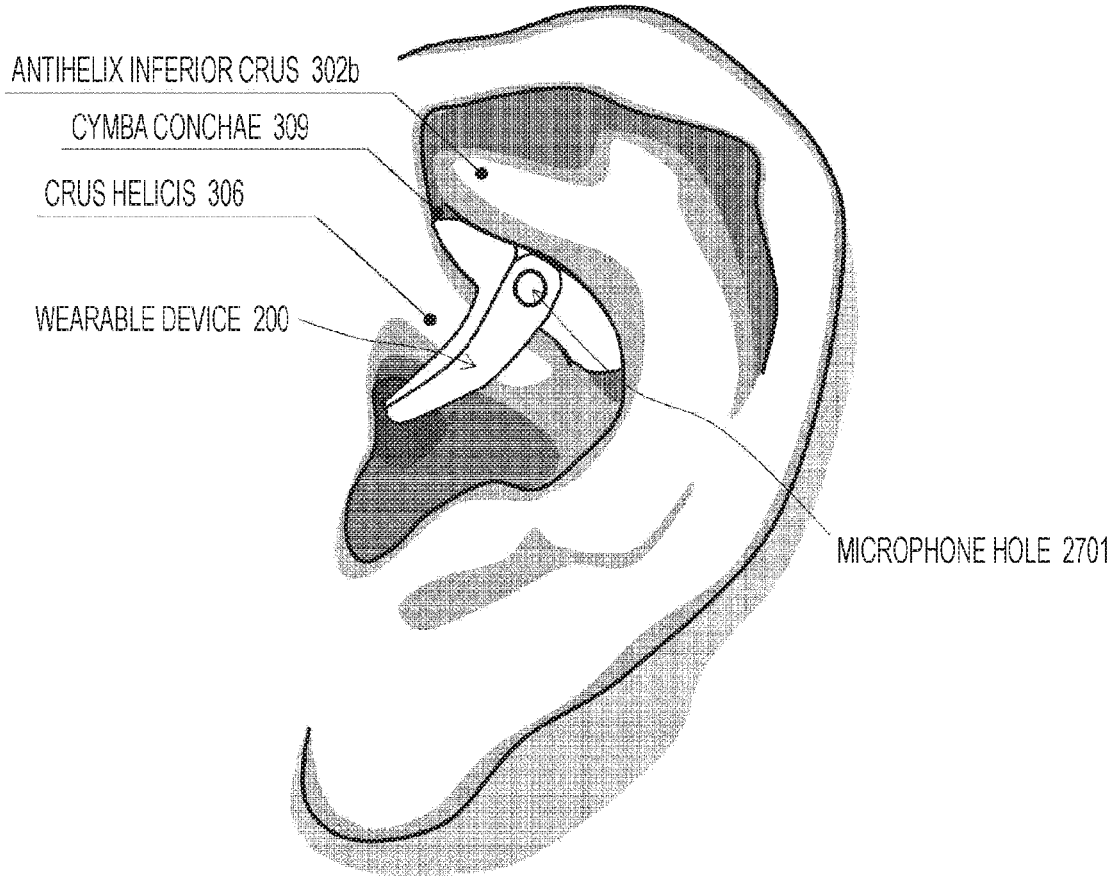
FIG. 27 is a view illustrating a state where the wearable device 200 having the microphone hole is inserted in the cymba conchae 309.

For reference, FIG. 26 illustrates a state where the wearable device 200 having the microphone hole 2301 formed in a wall surface of an outer casing as illustrated in FIG. 23 is inserted in the cymba conchae 309. In addition, FIG. 27 illustrates a state where the wearable device 200 having a microphone hole 2701 formed in the wall surface of the sound guiding tube in place of the outer casing is inserted into the cymba conchae 309. In the example illustrated in FIG. 27, it is assumed that the microphone is supported inside the sound guiding tube instead of the outer casing, the microphone hole 2701 is formed in the wall surface of the sound guiding tube according to the installation place of the microphone. In any of the examples illustrated in FIG. 26 and FIG. 27, in a state where the wearable device 200 is attached to the auricle, the microphone hole is directed toward the outside (a side opposite to the auricle), and becomes an entrance of air vibrations (sound waves) from the surroundings.

INDUSTRIAL APPLICABILITY

The technology disclosed in this specification has been described in detail with reference to specific embodiments. However, it is self-evident that those skilled in the art can make modifications and substitutions of the embodiments without departing from the gist of the technology disclosed in this specification.

The wearable device according to the technique disclosed in this specification has the following features: when applied to a sound output device, the wearable device is worn on the ear of a listener and used in the same way as a so-called earphone; however, the wearable device can output the sound information at the same time while realizing the listening characteristic of the ambient sound equivalent to anon-worn state even in a worn state, and the wearable device seems not to block the ear hole of a listener from surrounding people even in the worn state.

By taking advantage of this features, the sound output device to which the technique disclosed in this specification can be applied to various sports fields (such as during play and remote coaching) conducted outdoors and indoors including walking, jogging, cycling, climbing, skiing, and snowboarding, communication or presentation field where ambient sound listening and audio information presentation are required at the same time (for example, supplementary information at the time of seeing a play, museum audio information presentation, bird watching (birdcall listening)), driving or navigation, security guards, news casters, and the like.

Further, the wearable device according to the technology disclosed in this specification can be applied to an earphone with a microphone, or various sensors such as a biosensor that detects biological information by being attached to an auricle can be incorporated.

Technologies disclosed herein have been described in the form of exemplifications. Therefore, the description content of this specification should not be interpreted restrictively. In order to determine the gist of the technology disclosed in this specification, the scope of claims should be taken into consideration.

Note that the technology disclosed in this specification may have the following configuration.

(1) A wearable device including:

an outer casing having a shape adapted to a first valley portion of an auricle; and a component supported inside the outer casing, the wearable device being disposed in the first valley portion and used while being held by the auricle.

(2) The wearable device according to the (1), in which the outer casing is formed into an elongated or streamlined shape adapted to a cymba conchae as the first valley portion, and the wearable device is held by the auricle so as to be sandwiched between an antihelix inferior crus and a crus helicis when placed in the cymba conchae.

(3) The wearable device according to (1) above, in which the component supported inside the outer casing includes a sound generating unit configured to generate audio.

(4) The wearable device according to the above (3), in which the sound generating unit includes a vibration element and a weight attached to the vibrator.

(5) The wearable device according to the above (4), in which the vibration element has one end that is a fixed end fixed to an inner wall of the outer casing and the other end that is an open end, and the weight is attached to a side of the open end.

(6) The wearable device according to the above (4), in which the vibration element includes a bimorph element.

(7) The wearable device according to the above (4), in which the outer casing has an elongated shape, and the vibration element is disposed along a longitudinal direction of the outer casing, (8) The wearable device according to the above (4), in which the outer casing is a completely sealed structure.

(9) The wearable device according to the above (5), in which the outer casing fixes the fixed end of the vibration element at a predetermined crimping pressure.

(10) The wearable device according to the above (3), in which the sound generating unit includes one of a speaker of a dynamic speaker, a balanced armor type speaker, a capacitor type speaker, a piezoelectric speaker, and an electrostatic speaker.

(11) The wearable device according to the above (10), in which the sound generating unit further includes a sound guiding tube.

(12) The wearable device according to the above (11), in which the sound guiding tube has a gently curved shape, the sound guiding tube has one end joined to the outer casing, and when the outer casing is disposed in the first valley portion, the other end between the sound guidings reaches near an ear canal entrance.

(13) The wearable device according to the above (3), in which the component supported inside the outer casing further includes a microphone that collects audio.

(14) The wearable device according to the above (1), in which the component supported inside the outer casing includes a sensor.

(15) The wearable device according to the above (1), further including a flexible cushion portion that covers a surface of the outer casing.

(16) The wearable device according to the above (1), further including an adapter having a holding portion that holds the outer casing and an engaging portion having a shape adapted to a second valley portion of the auricle.

(17) The wearable device according to the above (16), in which the holding portion holds the outer casing and has a shape adapted to the first valley portion.

(18) The wearable device according to the above (16), in which the first valley portion is a cymba conchae, and the second valley portion is a triangular fossa.

(19) The wearable device according to the above (1), further including a cable that inputs/outputs a signal to/from the component or supplies power to the component.

(20) The wearable device according to the above (19), in which the wearable device connects the cable so as to be along a lower side surface when the outer casing is inserted into the first valley portion.

REFERENCE SIGNS LIST

100 Wearable device
110 Outer casing
111 Microphone hole
120 Sound generating unit
121 Vibration element
122 Weight
123 Cable
130 Microphone
131 Microphone signal line
200 Wearable device
210 Outer casing
220 Sound guiding tube
230 Sound generating unit
600 Adapter
601 Holding portion
602 Engaging portion
2201 Magnet
2202 Voice coil
2203 Diaphragm
2301 Microphone hole

The invention claimed is:

1. A wearable device, comprising:

an outer casing having a shape configured to be inserted into a first valley portion of an auricle;

a component inside the outer casing; and an adapter including:

a recessed holding portion configured to hold the outer casing, wherein the recessed holding portion has a shape configured to be inserted into the first valley portion of the auricle; and an engaging portion extended from the holding portion, the engaging portion having a shape configured to be inserted into a second valley portion of the auricle, wherein the first valley portion and the second valley portion are two of a cymba conchae, a cavum conchae, a tragus vicinity, a triangular fossa, or a scaphoid fossa.

2. The wearable device according to claim 1, wherein the outer casing has an elongated or streamlined shape configured to be inserted into the cymba conchae as the first valley portion, and the outer casing is holdable by the auricle so as to be sandwiched between an antihelix inferior crus and a crus helicis in case the outer casing is placed in the cymba conchae.

3. The wearable device according to claim 1, wherein the component supported inside the outer casing includes a sound generating unit, the sound generating unit is configured to generate audio.

4. The wearable device according to claim 3, wherein the sound generating unit includes a vibration element and a weight attached to the vibration element.

5. The wearable device according to claim 4, wherein the vibration element has a first end that is fixed to an inner wall of the outer casing and the a second end that is an open end, and the weight is attached to a side of the open end.

6. The wearable device according to claim 4, wherein the vibration element includes a bimorph element.

7. The wearable device according to claim 4, wherein the outer casing has an elongated shape, and the vibration element is along a longitudinal direction of the outer casing.

8. The wearable device according to claim 4, wherein the outer casing is a sealed structure.

9. The wearable device according to claim 5, wherein the outer casing is configured to fix the first end of the vibration element at a determined crimping pressure.

10. The wearable device according to claim 3, wherein the sound generating unit includes one of a dynamic speaker, a balanced armor type speaker, a capacitor type speaker, a piezoelectric speaker, or an electrostatic speaker.

11. The wearable device according to claim 10, wherein the sound generating unit further includes a sound guiding tube.

12. The wearable device according to claim 11, wherein the sound guiding tube has a gently curved shape, the sound guiding tube has a first end joined to the outer casing, and in case the outer casing is in the first valley portion, a second end of the sound guiding tube reaches near an ear canal entrance.

13. The wearable device according to claim 3, wherein the component supported inside the outer casing further includes a microphone configured to collect audio.

14. The wearable device according to claim 1, wherein the component supported inside the outer casing includes a sensor.

15. The wearable device according to claim 1, further comprising a flexible cushion portion configured to cover a surface of the outer casing.

16. The wearable device according to claim 1, wherein the first valley portion is the cymba conchae, and the second valley portion is the triangular fossa.

17. The wearable device according to claim 1, further comprising a cable configured to:

one of input a signal to the component or output a signal from the component; and supply power to the component.

18. The wearable device according to claim 17, wherein the wearable device is configured to connect the cable to be along a lower side surface of the outer casing in case the outer casing is inserted into the first valley portion.

* * * * *